US011222531B2

(12) United States Patent
Mubarek et al.

(10) Patent No.: US 11,222,531 B2
(45) Date of Patent: Jan. 11, 2022

(54) METHOD, APPARATUS, AND SYSTEM FOR PROVIDING DYNAMIC WINDOW DATA TRANSFER BETWEEN ROAD CLOSURE DETECTION AND ROAD CLOSURE VERIFICATION

(71) Applicant: HERE Global B.V., Eindhoven (NL)

(72) Inventors: Omer Mubarek, Chicago, IL (US); Colin Watts-Fitzgerald, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 203 days.

(21) Appl. No.: 16/687,239

(22) Filed: Nov. 18, 2019

(65) Prior Publication Data

US 2021/0150894 A1 May 20, 2021

(51) Int. Cl.
*G08G 1/00* (2006.01)
*G08G 1/01* (2006.01)

(52) U.S. Cl.
CPC ..... *G08G 1/0141* (2013.01); *G08G 1/012* (2013.01); *G08G 1/0129* (2013.01); *G08G 1/0133* (2013.01)

(58) Field of Classification Search
CPC .... G08G 1/0141; G08G 1/012; G08G 1/0129; G08G 1/0133
USPC ..... 701/117
See application file for complete search history.

(56) References Cited

U.S. PATENT DOCUMENTS 7,447,588 B1 * 11/2008 Xu ..... G08G 1/0104 340/988
10,062,281 B1 * 8/2018 Brookins ..... G01C 21/3492
10,847,029 B2 * 11/2020 Mubarek ..... G08G 1/0112
11,004,334 B2 * 5/2021 Mubarek ..... G08G 1/0133
2007/0032946 A1 * 2/2007 Goto ..... G01C 21/3848 701/93
2009/0271101 A1 * 10/2009 Relyea ..... H04W 4/50 701/118

(Continued)

FOREIGN PATENT DOCUMENTS

JP 2014071820 A 4/2014
WO 2014147200 A1 9/2014

OTHER PUBLICATIONS

Office Action for related European Application No. 20208166.7-1213, dated Apr. 14, 2021, 20 pages.

*Primary Examiner* — Kerri L McNally
*Assistant Examiner* — Thang D Tran
(74) *Attorney, Agent, or Firm* — Ditthavong, Steiner & Mlotkowski

(57) ABSTRACT

An approach is provided for verification of a road closure. The approach, for example, involves generating a road graph comprising a road links associated with a road closure detected by a road closure detection system. The road closure detection system stores probe data for the road links collected over respective detection dynamic time windows. The approach also involves extracting respective verification dynamic time windows for the road links that are used by a road closure verification system to verify the road closure. The approach further involves filling the respective verification dynamic time windows using the probe data stored by the road closure detection system. The approach further involves initiating a verification of the road closure based on the filled respective verification dynamic time windows.

20 Claims, 15 Drawing Sheets

(56) References Cited

U.S. PATENT DOCUMENTS

| | | | | |
|---|---|---|---|---|
| 2011/0307165 | A1* | 12/2011 | Hiestermann | G01C 21/3492 701/119 |
| 2015/0161886 | A1* | 6/2015 | Kesting | G08G 1/012 701/117 |
| 2015/0170514 | A1* | 6/2015 | Stenneth | G08G 1/0133 701/117 |
| 2016/0076896 | A1* | 3/2016 | Konig | G08G 1/0133 701/411 |
| 2016/0078758 | A1* | 3/2016 | Basalamah | G08G 1/0141 701/118 |
| 2016/0171886 | A1* | 6/2016 | Vorona | G08G 1/0129 701/119 |
| 2016/0335923 | A1* | 11/2016 | Hofmann | G09B 29/003 |
| 2016/0371977 | A1* | 12/2016 | Wingate | G08G 1/096844 |
| 2017/0098373 | A1* | 4/2017 | Filley | G08G 1/096708 |
| 2017/0277716 | A1* | 9/2017 | Giurgiu | G06F 16/2365 |
| 2018/0003512 | A1* | 1/2018 | Lynch | G01C 21/32 |
| 2018/0158325 | A1* | 6/2018 | Bernhardt | G01C 21/3415 |
| 2018/0252541 | A1* | 9/2018 | Kesting | G01C 21/3415 |
| 2018/0342165 | A1* | 11/2018 | Sweeney | G08G 1/0133 |
| 2019/0051162 | A1* | 2/2019 | Malkes | G08G 1/081 |
| 2019/0114909 | A1* | 4/2019 | Halama | G08G 1/096716 |
| 2019/0122544 | A1* | 4/2019 | Schlesinger | G08G 1/0108 |
| 2019/0301891 | A1* | 10/2019 | Rowitch | G01C 21/32 |
| 2020/0372322 | A1* | 11/2020 | Wang | G08G 1/0116 |
| 2021/0020038 | A1* | 1/2021 | Weldemariam | G08G 1/096775 |

* cited by examiner

FIG. 5A

500

| | | | | | | | | | | |
|---|---|---|---|---|---|---|---|---|---|---|
| Actual Volume | 0 | 1 | 1 | 2 | 1 | 3 | 2 | 1 | 1 | 0 |
| Historic Volume | 3 | 3 | 2 | 2.5 | 5 | 4 | 2 | 1 | 0 | 0 |
| Epochs | $e_0$ | $e_1$ | $e_2$ | $e_3$ | $e_4$ | $e_5$ | $e_6$ | $e_7$ | $e_8$ | $e_9$ |

FIG. 5B

510

511

| | | | | | | | | | | |
|---|---|---|---|---|---|---|---|---|---|---|
| Actual Volume | 0 | 1 | 1 | 2 | 1 | 3 | 2 | 1 | 1 | 0 |
| Historic Volume | 3 | 3 | 2 | 2.5 | 5 | 4 | 2 | 1 | 0 | 0 |
| Epochs | $e_0$ | $e_1$ | $e_2$ | $e_3$ | $e_4$ | $e_5$ | $e_6$ | $e_7$ | $e_8$ | $e_9$ |

FIG. 5C

520

521

511

| | | | | | | | | | | |
|---|---|---|---|---|---|---|---|---|---|---|
| Actual Volume | 0 | 1 | 1 | 2 | 1 | 3 | 2 | 1 | 1 | 0 |
| Historic Volume | 3 | 3 | 2 | 2.5 | 5 | 4 | 2 | 1 | 0 | 0 |
| Epochs | $e_0$ | $e_1$ | $e_2$ | $e_3$ | $e_4$ | $e_5$ | $e_6$ | $e_7$ | $e_8$ | $e_9$ |

Sum = 3

METHOD, APPARATUS, AND SYSTEM FOR PROVIDING DYNAMIC WINDOW DATA TRANSFER BETWEEN ROAD CLOSURE DETECTION AND ROAD CLOSURE VERIFICATION

BACKGROUND

Providing data on traffic incidents (e.g., abnormalities in traffic that can affect traffic flow such as accidents, lane closures, road closures, etc.) is an important function for map service providers. In particular, while most traffic incidents can have at least some negative impact on traffic, road closures can be the most severe because no cars can go through the affected roadway. The lack of knowledge about a road closure can have enormous negative impact on trip planning, routing, and estimated time of arrival. Therefore, traffic service providers face significant technical challenge to reporting road closures accurately. For example, to improve the road accuracy of road closures, service providers can implement a road closure detection system to first detect road closures across a broad geographic area and then a road closure verification detection to more specifically verify the detected road closure (e.g., confirm the closure and/or determine changes in the closure). However, this dual approach can increase the latency for reporting road closures because both the detection and verification systems generally rely on observing road links of interest for over designated time windows (e.g., a dynamic time window) to detect and verify road closures.

SOME EXAMPLE EMBODIMENTS

Therefore, there providing dynamic time window data transfer between road closure detection and road closure verification to, for instance, reduce the time needed to verify and report a road closure.

According to one embodiment, a computer-implemented method comprises generating a road graph comprising a plurality of road links associated with a road closure detected by a road closure detection system. The road closure detection system stores probe data for the plurality of road links over respective detection dynamic time windows used for detecting the road closure. The method also comprises extracting respective verification dynamic time windows for the plurality of road links. The respective verification dynamic time windows are used by a road closure verification system to verify the road closure. The method further comprises filling the respective verification dynamic time windows using the probe data stored by the road closure detection system. The method further comprises initiating a verification of the road closure based on the filled respective verification dynamic time windows.

According to another embodiment, an apparatus comprises at least one processor, and at least one memory including computer program code for one or more computer programs, the at least one memory and the computer program code configured to, with the at least one processor, cause, at least in part, the apparatus to generate a road graph comprising a plurality of road links associated with a road closure detected by a road closure detection system. The road closure detection system stores probe data for the plurality of road links over respective detection dynamic time windows used for detecting the road closure. The apparatus is also caused to extract respective verification dynamic time windows for the plurality of road links. The respective verification dynamic time windows are used by a road closure verification system to verify the road closure. The apparatus is further caused to fill the respective verification dynamic time windows using the probe data stored by the road closure detection system. The apparatus is further caused to initiate a verification of the road closure based on the filled respective verification dynamic time windows.

According to another embodiment, a non-transitory computer-readable storage medium carries one or more sequences of one or more instructions which, when executed by one or more processors, cause, at least in part, an apparatus to generate a road graph comprising a plurality of road links associated with a road closure detected by a road closure detection system. The road closure detection system stores probe data for the plurality of road links over respective detection dynamic time windows used for detecting the road closure. The apparatus is also caused to extract respective verification dynamic time windows for the plurality of road links. The respective verification dynamic time windows are used by a road closure verification system to verify the road closure. The apparatus is further caused to fill the respective verification dynamic time windows using the probe data stored by the road closure detection system. The apparatus is further caused to initiate a verification of the road closure based on the filled respective verification dynamic time windows.

According to another embodiment, an apparatus comprises means for generating a road graph comprising a plurality of road links associated with a road closure detected by a road closure detection system. The road closure detection system stores probe data for the plurality of road links over respective detection dynamic time windows used for detecting the road closure. The apparatus also comprises means for extracting respective verification dynamic time windows for the plurality of road links. The respective verification dynamic time windows are used by a road closure verification system to verify the road closure. The apparatus further comprises means for filling the respective verification dynamic time windows using the probe data stored by the road closure detection system. The apparatus further comprises means for initiating a verification of the road closure based on the filled respective verification dynamic time windows.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing a method of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings:

FIGS. 5A-5K illustrate how the sliding dynamic window mechanism works with respect to a detailed example, according to one embodiment;

DESCRIPTION OF SOME EMBODIMENTS

Examples of a method, apparatus, and computer program for providing dynamic window data transfer between road closure detection and road closure verification are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

Figure 1:
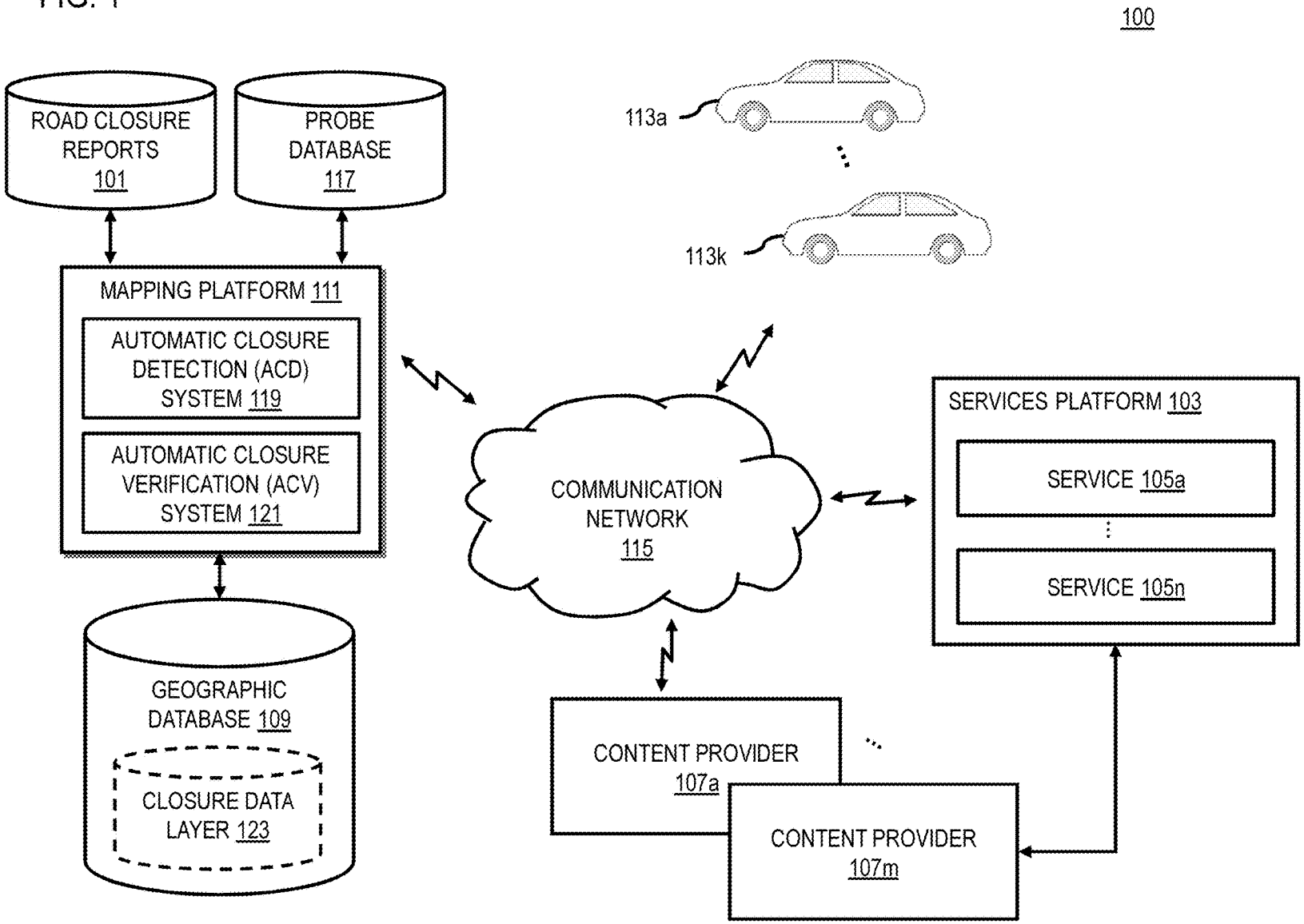
FIG. 1 is a diagram of a system capable of providing dynamic window data transfer between road closure detection and road closure verification, according to one embodiment.

FIG. 1 is a diagram of a system 100 capable of providing dynamic window data transfer between road closure detection and road closure verification, according to one embodiment. As noted above, information on road closures occurring in a road network can be important for providing services such as trip planning, navigation routing or guidance, estimating time of arrival, and/or the like. Generally, traffic incidents such as road closures (e.g., road closure reports 101) are published by government/municipality agencies, local police, and/or third-party official/semi-official sources (e.g., a services platform 103, one or more services 105*a*-105*n*, one or more content providers 107*a*-107*m*, etc.). By way of example, the published road closure reports 101 can specify the roadway (e.g., by name or matched to specific road link records of digital map data such as a geographic database 109) that has been closed or partially closed to traffic (e.g., vehicular and/or non-vehicular traffic). Closure refers, for instance, to restricting traffic flow on a particular roadway such that no vehicle or a reduced number of vehicle (e.g., reduced with respect to an average free flow traffic volume on the roadway) is permitted or able to travel on the roadway.

In one embodiment, the system 100 uses a mapping platform 111 (e.g., operated by a traffic provider) that includes two systems to detect and verify road closures using probe data (e.g., GPS probe data collected from vehicles 113*a*-113*k*, also collectively referred to as vehicles 113, over a communication network 115 and stored in a probe database 117). As shown, these systems are an Automatic Closure Detection (ACD) system 119 and Automatic Closure Verification (ACV) system 121.

In one embodiment, both of these systems 119 and 121 use an important methodology when evaluating road closure states: e.g., they use observations from the current time as well as they look back a short period of time into the near history (e.g., 1 hour) and use those observations to make a decision on the closure state of the road. This latter functionality requires remembering data from the past to be used in current and future evaluations. These past observations/data are stored in a "dynamic window" (also referred to as a dynamic time window) for each road segment.

In one embodiment, the ACD system 119 (e.g., road closure detector) monitors a large geographic area (e.g., the entire world) continuously (e.g., 24 hours per day/7 days per week) and looks for anomalies in probe behavior to flag potential road closures. On the other hand, the ACV system 121 (e.g., road closure verifier) focuses only on roads that are either flagged by ACD system 119 or reported by third party providers. For example, the ACV system 121 monitors the roads on which road closures are detected, evaluates them, and provides the final verdict (e.g., whether the flagged roads are closed or not).

However, when the ACV system 121 starts monitoring a new potential road closure (e.g., detected by the ACD system 119), it has no data from the past; hence its dynamic time window is empty. As a result, the ACV system 121 has to wait to observe enough data to fill up this window, such that it can start making evaluations concerning the closure state of the road. Until this window is activated (e.g., has enough observed data to meet a threshold minimum), the ACV system 121 cannot make any evaluations. Therefore, during this time (e.g., the time to fill the dynamic time window for verification), the ACV system 121 will not be able to add any value, which in many cases might last for a few hours (e.g., depending on the dynamic time window size used for verification). This can cause inaccuracies in the road closure data in mapping platform 111's traffic system (e.g., the road closure data layer 123 of the geographic database 109) and inconveniences for its end users and customers. Accordingly, there are significant technical challenges associated with reducing the wait time or latency for the ACV system 121 to observe enough data to make a road closure verification.

To address these technical challenges, the system 100 of FIG. 1 introduces a capability to speed up the construction of the dynamic verification time windows (e.g., ACV dynamic windows) for each road segment evaluated by the ACV system 121. In other words, the various embodiments described herein advantageously shortens the time to gather the near-past observations, such that ACV system 121 can be activated quicker to verify a detected road closure (e.g., detected by the ACD system 119). In one embodiment, the system 100 leverages the information stored in detection dynamic time windows (e.g., ACD dynamic windows) during the road closure detection process performed by the ACD system 119. This is possible, because in one embodiment, the ACD system 119 is configured to monitor a large geographic area (e.g., the entire world all the time), and when the ACV system 121 starts monitoring a road (e.g., that has been flagged by the ACD system 119), the ACD system 119 already has past data on these roads. The various embodiments discussed herein describe multiple solutions for the ACV system 121 to make use of this data to construct its own data to verify a detected road closure. These solutions, for instance, result in several advantages including but not limited to:

- The embodiments described herein reduce the wait time for the ACV system 121 to activate and evaluate potential closures.
- It leverages already existing ACD and ACV architectures. These systems do not have to be developed/designed from scratch.
- It leverages already existing ACD-ACV interface. This interface doesn't have to be developed/designed from scratch.
- The ACD system 119 already stores data in its dynamic windows for detection (e.g., detection dynamic time windows). Similarly, the ACV system 121 already builds dynamic windows for verification (e.g., verification dynamic time windows). In one embodiment, the lengths of these dynamic windows (e.g., the detection and verification dynamic time windows) are the same; the difference is what attributes they store. The embodiments of the approach for transferring information from ACD dynamic windows (e.g., the detection dynamic time windows) to ACV dynamic windows (e.g., the verification dynamic time windows) is therefore compatible with how these systems function.
- In one embodiment, the ACD system 119 can store actual probes on top of the attributes already used by the ACD system 119. While this additional storage of the probe data can increase the memory footprint, the system 100 can mitigate the increase by limiting the number of probes that are to be stored. For example, in one embodiment, the ACD system 119 can be configured to store only a few (e.g., 10) probes per road segment.

Figure 2:
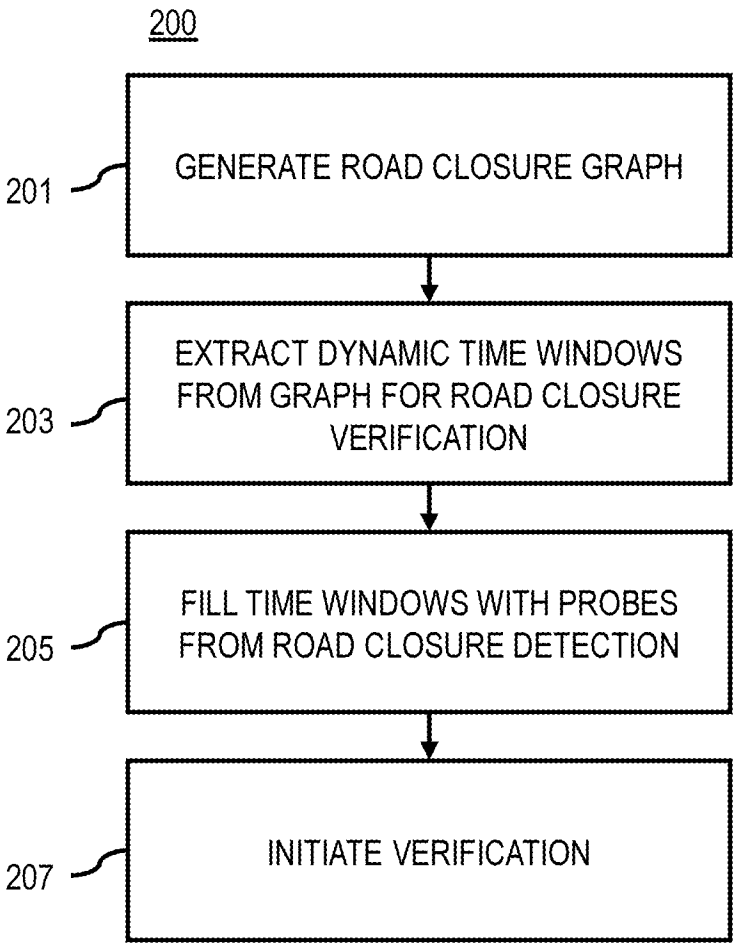
FIG. 2 is a flowchart of a process for providing dynamic window data transfer between road closure detection and road closure verification, according to one embodiment.
Figure 3:
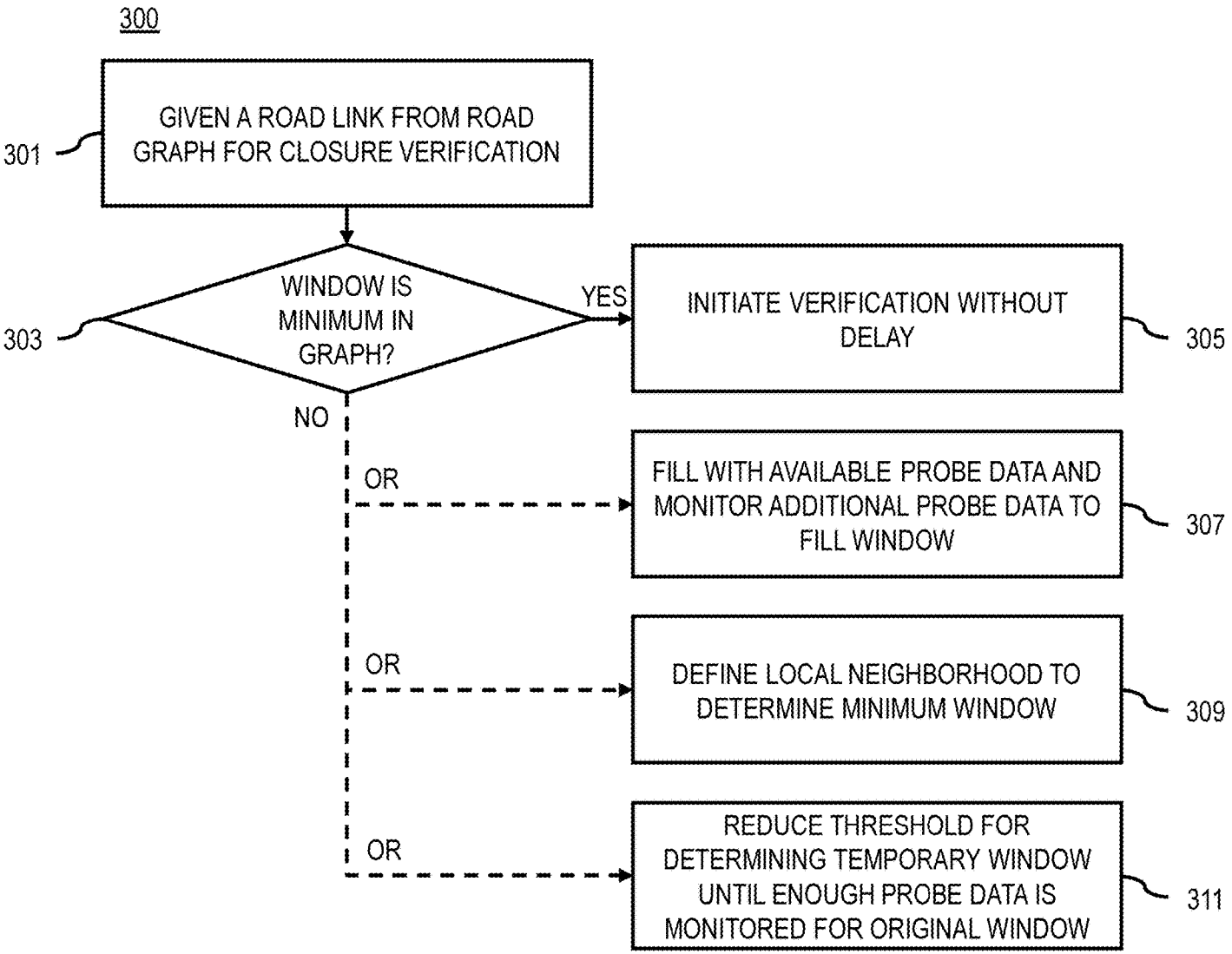
FIG. 3 is a flowchart of a process for providing solutions for filling verification dynamic windows using data collected in the road closure detection dynamic windows, according to one embodiment.
Figure 10:
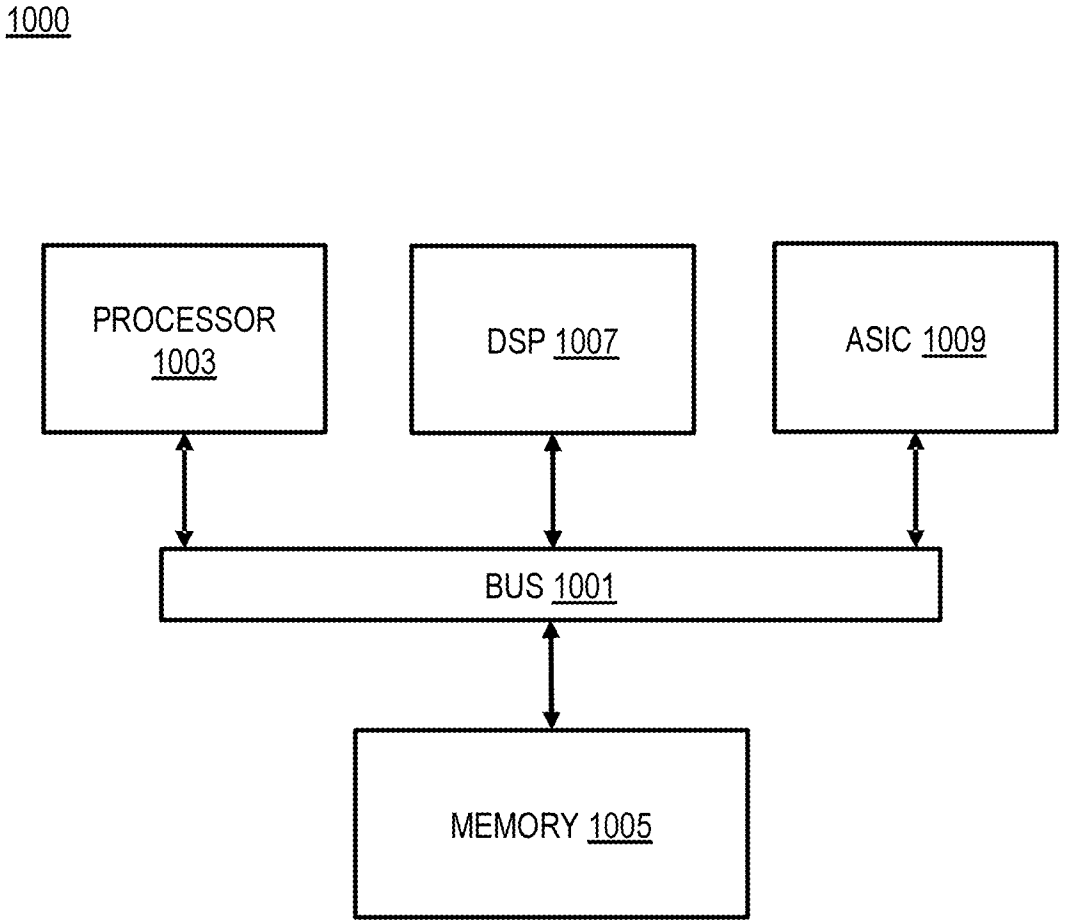
FIG. 10 is a diagram of a chip set that can be used to implement an embodiment.

The technical solutions provided by the system 100 are described in more detail with respect to the process 200 of FIG. 2 and process 300 of FIG. 4 below. FIG. 2 is a flowchart of a process 200 for providing dynamic window data transfer between road closure detection and road closure verification, according to one embodiment. FIG. 3 is a flowchart of a process for providing solutions for filling verification dynamic windows using data collected in the road closure detection dynamic windows, according to one embodiment. In one embodiment, the process 200 of FIG. 2 is performed with one or more of the options or solutions described in the process 300 of FIG. 3. In various embodiments, the ACV system 121 may perform one or more portions of the processes 200 and 300 alone or in combination with the ACD system 119, and may be implemented in, for instance, a chip set including a processor and a memory as shown in FIG. 10. As such, the ACV system 121 and ACD system 119 can provide means for accomplishing various parts of the processes 200 and 300, as well as means for accomplishing embodiments of other processes described herein in conjunction with other components of the system 100. Although the processes 200 and 300 are illustrated and described as a sequence of steps, it is contemplated that various embodiments of the processes 200 and 300 may be performed in any order or combination and need not include all of the illustrated steps.

In one embodiment, the processes 200 and 300 are part of a system and methodology to automatically detect and verify road closures using GPS probe data. Specifically, the embodiments described herein give an overview of the Automatic Closure Detection (ACD) and Automatic Closure Verification (ACV) systems and how these systems work hand-in-hand. In addition, the embodiments describes the dynamic window concept used in the ACD system 119 to enhance road closure detection quality, and how the dynamic window concept is ported to the ACV system 121 efficiently by making used of the dynamic window data readily available in the ACD system 119.

In one embodiment, the ACD system 119 uses a dynamic window for road closure detection. The ACD system 119 is a component of the mapping platform 111's traffic system, which monitors vehicle activity using probes to determine whether a particular road is closed to traffic. At a high level, the ACD system 199 monitors probe data on road segments within its coverage area and generates a set of features (e.g., based on the probe data) which indicate an anomaly with monitored road (e.g., an anomaly indicative of a road closure on the monitored road).

In one embodiment, some of these features include, but not limited to, historically expected volumes (e.g., vehicle volumes) as well as real-time actual observed volumes (e.g., vehicle volumes) on road segments. The features, for instance, are calculated every epoch, where an epoch is a designated time period (e.g., 5 minutes, 1 hour, etc.). Relying on the most recent epoch's features is risky, as sudden fluctuations in actual volumes can throw off the accuracy of the road closure detection. Therefore, the ACD system 119 also takes into account the same set of features over a past time window (e.g., past 1 hour, past 5 hours, etc.).

By way of example, the idea behind this window is to cover a longer time period where a large enough volume of vehicles is expected on the monitored road segment, such that if the actual volume is low, the ACD system 119 can flag the difference between expected and actual volumes as a sign of road closure. In one specific example, if a road segment expects 0.02 vehicles at a given epoch, and the actual volume is 0 vehicles, it is difficult to conclude a closure. However, if the window over past epochs is designed such that a higher number of vehicles (e.g., 10 vehicles) are expected during that window, then an actual volume of 0 during this window is a much stronger proof towards a road closure.

Figure 4A:
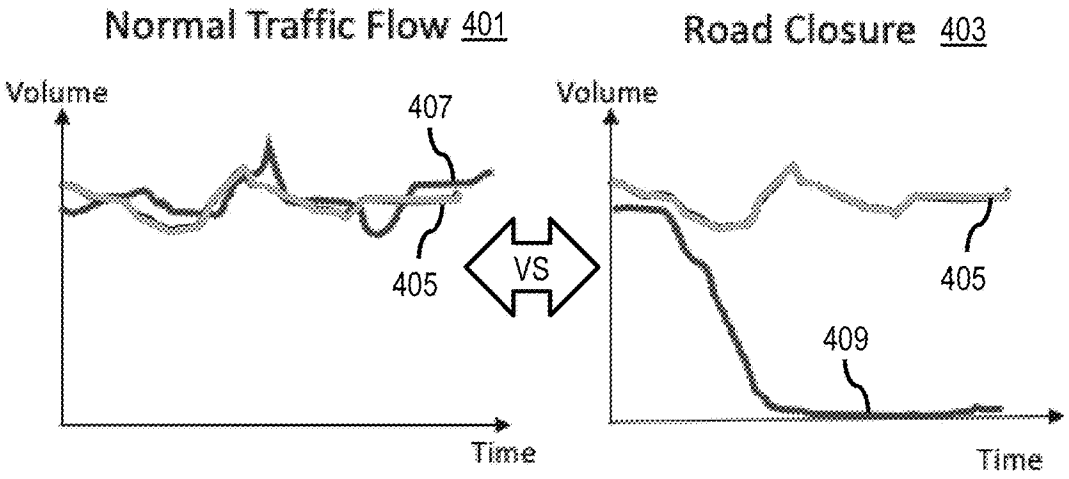
FIGS. 4A and 4B are diagrams illustrating examples of expected and real-time volumes determined for example road segments, according to one embodiment.
Figure 4B:
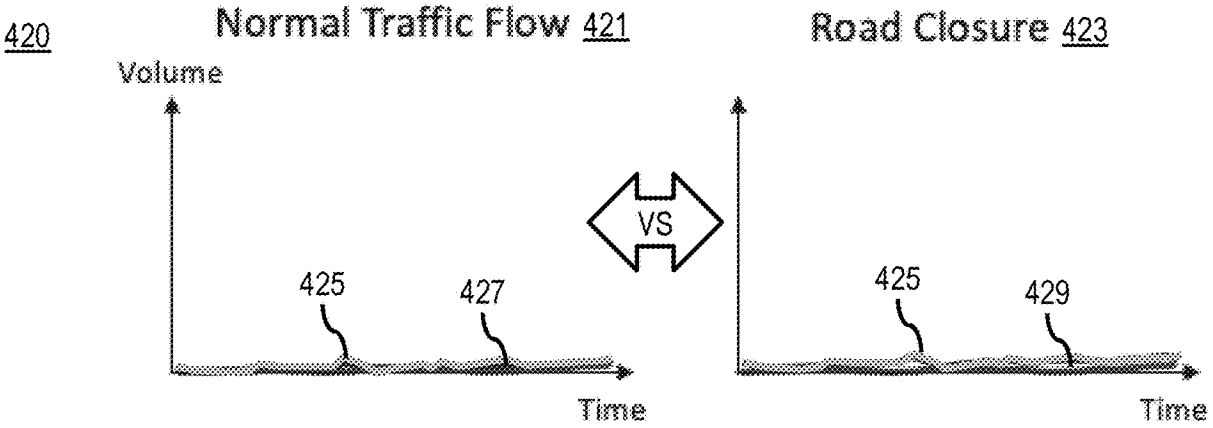

FIGS. 4A and 4B illustrate this specific example. In one embodiment, the ACD system 119 can flag a potential road closure, if it sees a difference (e.g., greater than a threshold difference) between expected and real-time volumes. This difference is depicted clearly in the example 400 of FIG. 4A which depicts volume data on a busy road segment. As shown, FIG. 4A depicts a normal traffic plot 401 and a road closure plot 403 showing expected (e.g., indicated by line 405 both plots 401 and 403) versus real-time volumes (e.g., indicated by line 407 in the normal traffic flow plot 401 and by line 409 in the road closure plot 403). As shown, there is little difference between the expected volume line 405 and the real-time volume line 407 in the normal traffic flow plot 401 confirming that there is not likely a road closure on the road link at that time. However, in road closure plot 403, there is a significant difference (e.g., by more than a threshold difference) between the expected volume line 405 and the real-time volume line 409 indicating a potential road closure.

On the other hand, as shown in the example 420 of FIG. 4B which depicts volume data on a quiet road segment, if the expected volume is very low on a road segment, then the ACD system 119 cannot identify a meaningful difference (e.g., a difference greater than a threshold difference) between expected and real-time volumes. This is because the fact that no vehicles have passed through the road segment during the given time period can be either due to a road closure, or due to the regular volume of the road, through which no vehicles are expected to pass at that time, as depicted in FIG. 4B. In the example of FIG. 4B, the normal traffic flow plot 421 and road closure plot 423 illustrate an expected volume line 425 this has such low volumes (e.g., as indicated by the respective real-time volume lines 427 and 429) that the ACD system 119 cannot detect a difference between the normal traffic state and road closure state.

In one embodiment, the main idea in designing the width of the dynamic window is to look at a large enough time period such that the difference between expected and actual volumes can be highlighted in case of reduced actual volume, as demonstrated in FIG. 4A. That means, a busy road segment could have a window spanning 15 minutes, whereas a less busy road would have a window over 10 hours to reach the same total expected volume as that of the busy road segment. Hence, the window is dynamic.

Once the window size is specified, the ACD system 119 calculates the same features, which it did for current epoch. For instance, if two of the features for current epoch are expected vehicle volume and actual vehicle volume, the ACD system 119 calculates total expected vehicle volume and total actual vehicle volume observed over the entire window, however long the dynamic window for that particular road segment is.

In one embodiment, a dynamic time window for road closure detection is a variable size sliding window over n-minute epochs which satisfies the conditions such as but not limited to:

(1) The total expected vehicle volume of all the epochs that the dynamic window spans across, should be greater than or equal to a threshold volume, called EXPECTED_THRESH.

(2) The dynamic window should have a minimum size, called MIN_WINDOW_SIZE.

(3) The dynamic window should have a maximum size, called MAX_WINDOW_SIZE.

In one embodiment, the dynamic window operates as described below. Assume that at epoch i the dynamic window spans across N epochs (from epoch (i−N) to epoch i−1. In the next epoch (epoch (i+1)), the ACD system 119 calculates new current-epoch features. At the same time, the dynamic window adds epoch i as its most recent epoch, spanning over N+1 epochs. Depending on the expected volume of epoch i, the dynamic window might not need one or more of the oldest epochs in its window, while still satisfying conditions 1-2 listed above. Therefore, after sliding one epoch and adding a new epoch, the dynamic window can clean its oldest epochs while still satisfying the dynamic window conditions.

Figure 5D:
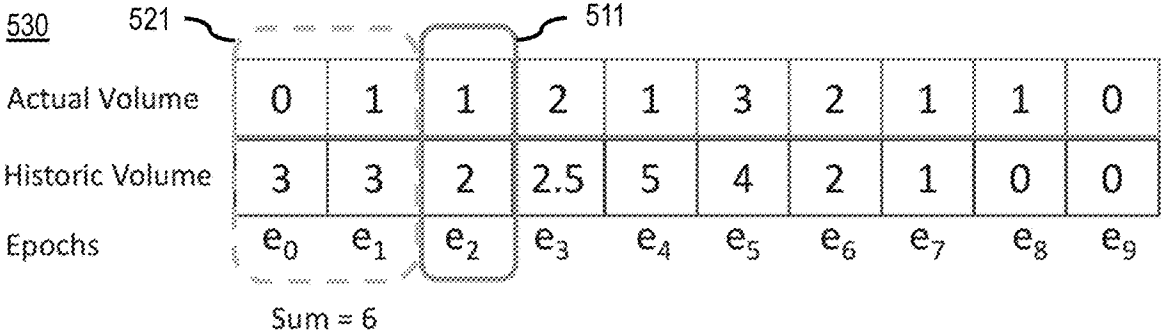

FIGS. 5A-5K illustrate how the sliding dynamic window mechanism works with respect to a detailed example, according to one embodiment. FIG. 5A illustrates a diagram 500 that contains two time series: one series for actual vehicle volume, and another series for expected vehicle volume derived from historical data. Calculation of historical data is described in more detail below. The time series cover epoch-0 (e0) to epoch-9 (e9).

The diagrams of FIGS. 5B-5K start at e0 and show the evolution of the dynamic window as time passes and new data arrives. In other words, while the diagrams depict "future" data (e.g., from the perspective of the current epoch in each diagram), the ACD system 119 only sees the current-epoch's data.

Diagram 510 of FIG. 5B illustrates the example with current epoch at e0. In one embodiment, the current epoch (denoted by a solid rectangle 511) is the first epoch seen by the ACD system 119 so far. As there is not a previous epoch available to the ACD system 100, the dynamic window construction process does not start yet, and no features for road closure detection are calculated.

As shown in diagram 520 of FIG. 5C, when the current epoch moves to e1, e0 is stored in the dynamic window. The dynamic window checks whether the total expected (historic) volume in the window is greater than EXPECTED_THRESH, which is 10 in this example. The sum is 3 and less than 10; therefore, the window is not activated yet. In this example, the inactive window is denoted by a dashed rectangle 521. Since the window is inactive, no features are calculated yet.

As shown in diagram 530 of FIG. 5D, the current epoch moves to e2 (denoted by rectangle 511). The dynamic window now includes e0 and e1, with a total expected vehicle count of 6. This sum is still less than EXPECTED_THRESH. Accordingly, the window is not activated (denoted by rectangle 521), and no features are calculated.

Figure 5E:
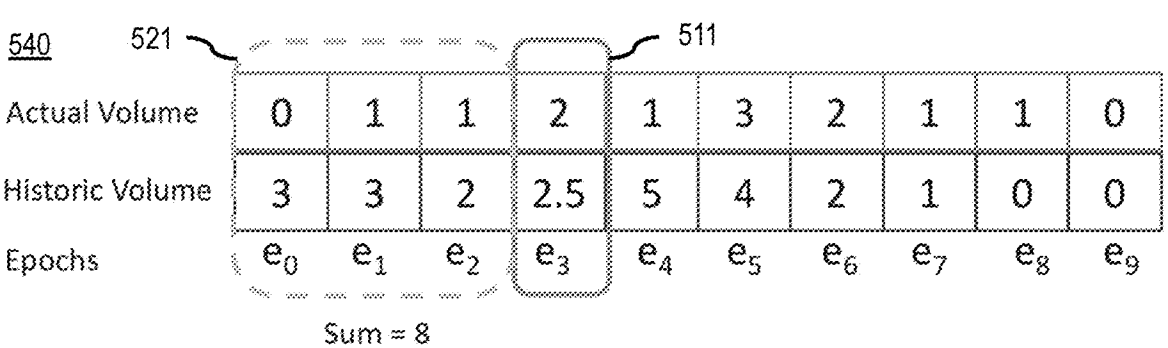

As shown in diagram 540 of FIG. 5E, the current epoch moves to e3 (denoted by rectangle 511). The dynamic window now includes e0, e1 and e2, with a total expected vehicle count of 8. This sum is still less than EXPECTED_THRESH. Accordingly, the window is not activated (denoted by rectangle 521), and no features are calculated.

Figure 5F:
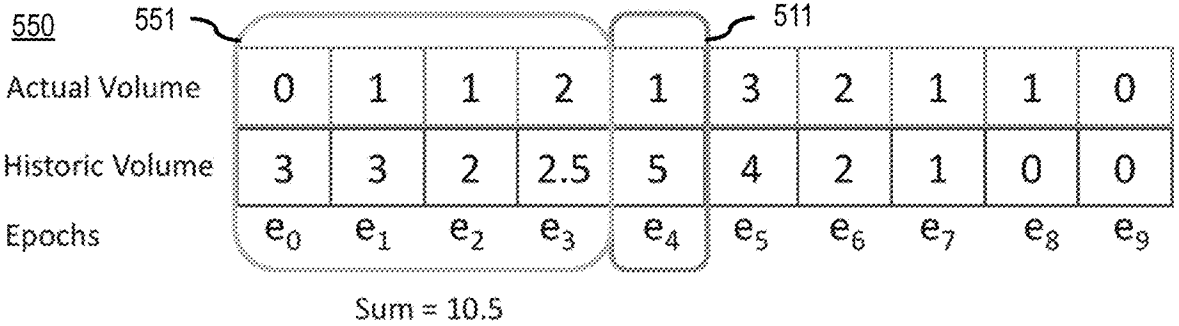

As shown in diagram 550 of FIG. 5F, the current epoch moves to e4 (denoted by rectangle 511). The dynamic window now includes e0, e1, e2 and e3, with a total expected vehicle count of 10.5. Finally, the total number of vehicles expected to be seen in the dynamic window is greater than EXPECTED_THRESH. Accordingly, the window is activated, which is denoted by a solid rectangle 551.

Before calculating the features for road closure detection, the ACD system 119 checks if older epochs can be removed from the window while maintaining total expected vehicles greater than EXPECTED_THRESH. The first candidate is the oldest epoch of the window: e0. However, removing e0 will take reduce the sum below the threshold (10.5−3=7.5). Therefore, no epochs are removed from the dynamic window.

The ACD system 119 then calculates features for road closure detection (specific details of the features are omitted here as they have no effect in explaining how the window is updated as time passes).

Figure 5G:
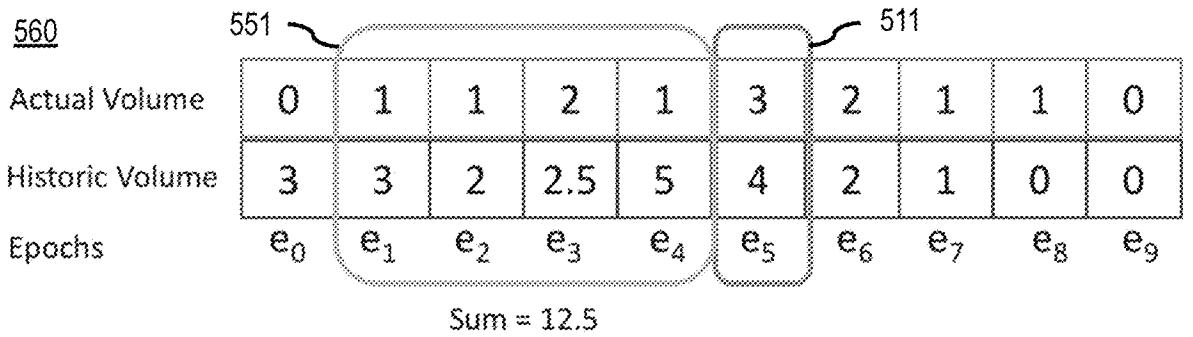

As shown in diagram 560 of FIG. 5G, the current epoch is e5 (denoted by rectangle 511). The dynamic window adds e4, spanning over e0-e4. Since the dynamic window has been activated once (denoted by rectangle 551), it will never become inactive again. The ACD system 119 checks if any older epochs can be removed from the dynamic window while maintaining its sum above EXPECTED_THRESH. In this example, e0 is not needed anymore; after removing e0, the window still has a total of 12.5 expected vehicles. The ACD system 119 then calculates features for road closure detection.

Figure 5H:
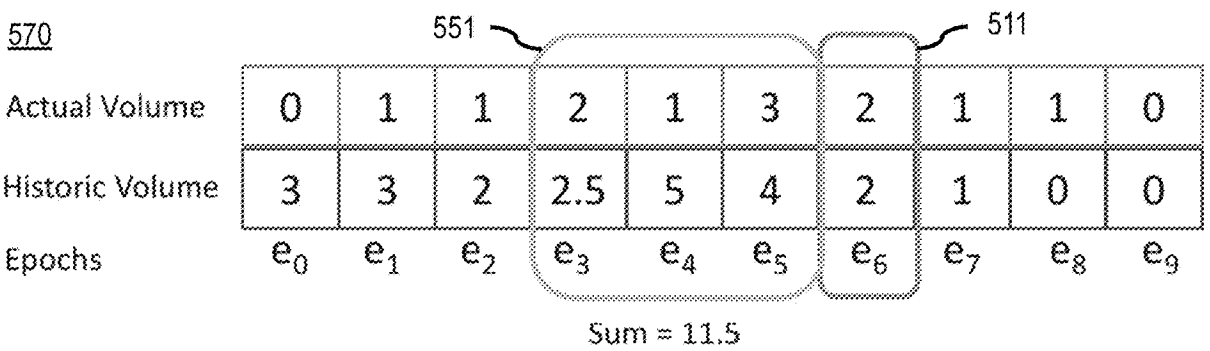

As shown in diagram 570 of FIG. 5H, the current epoch is e6 (denoted by rectangle 511). The dynamic window adds e5 spanning over e1-e5 (denoted by rectangle 551). The ACD system 119 then removes e1 and e2 because with e3-e5, the sum is still above the threshold. The ACD system 119 then calculates features for road closure detection.

Figure 5I:
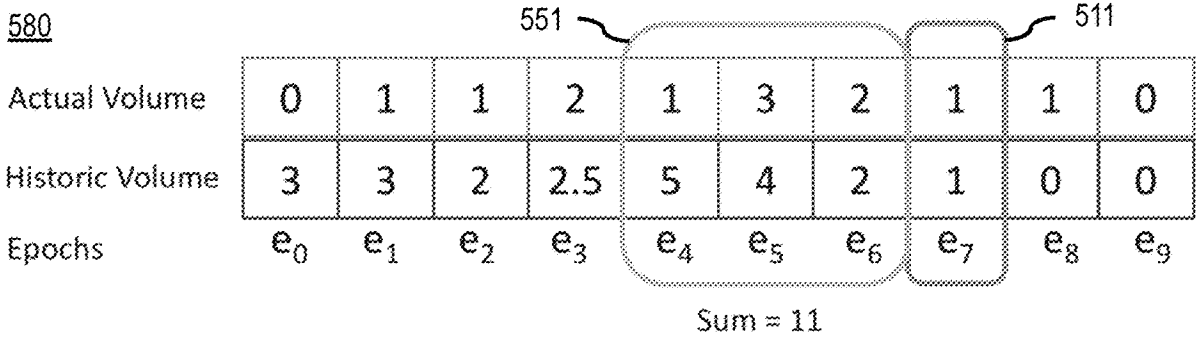

As shown in diagram 580 of FIG. 5I, the current epoch is e7 (denoted by rectangle 511). The dynamic window adds e6 spanning over e3-e6 (denoted by rectangle 551). The ACD system 119 then removes e3 because the sum (11) remains above the threshold. The ACD system 119 then calculates features for road closure detection.

Figure 5J:
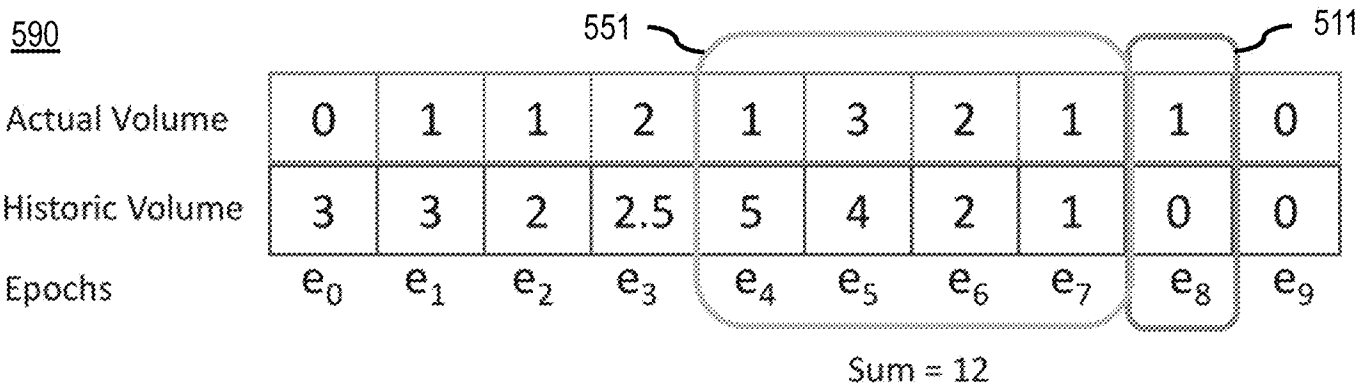

As shown in diagram 590 of FIG. 5J, the current epoch is e8 (denoted by rectangle 511). The dynamic window (denoted by rectangle 551) adds e7 and grows back to 4 epochs wide to meet the threshold. The ACD system 119 then calculates features for road closure detection.

Figure 5K:
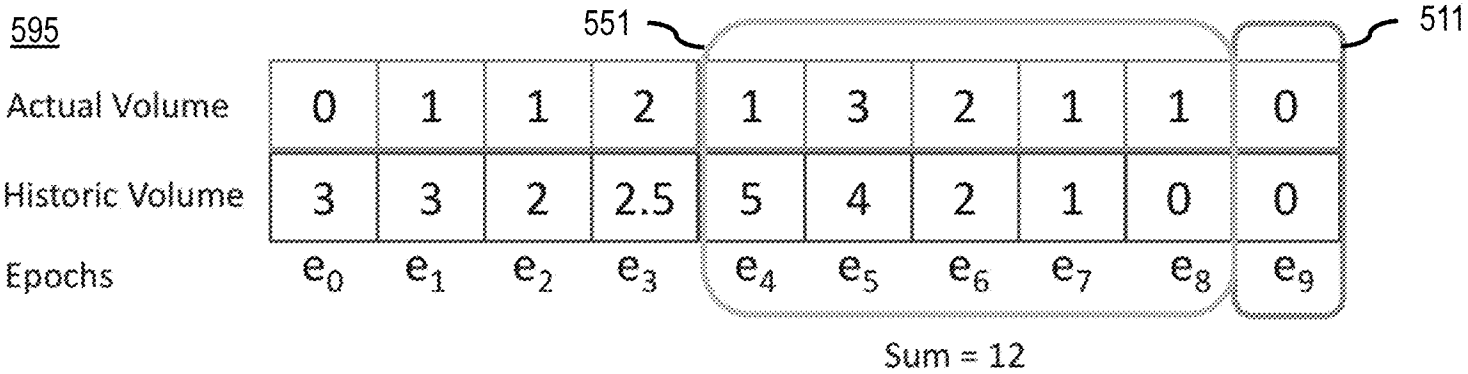

As shown in diagram 595 of FIG. 5K, the current epoch is e9 (denoted by rectangle 511). The dynamic window (denoted by rectangle 551) adds e8 and grows to 5 epochs wide. The ACD system 119 then calculates features for road closure detection.

At the end of the sliding dynamic window process illustrated above, the ACD system 119 flags any road links whose calculated features are indicative of a road closure (e.g., the real-time volume is less than the expected volume by more than a threshold difference).

As discussed above, in one embodiment, the ACV system 121 is used to verify a reported or potential road closure. By way of example, reported road closures originate from third party sources, such as government agencies, municipalities and other sources, which send road closure related information to the mapping platform 111. In addition or alternatively to these reports, the mapping platform 111 itself can use the ACD system 119 to flag potential road closures. Both of these types of reports can be verified by the ACV system 121.

In one embodiment, while the ACD system 119 and the ACV system 121 can take similar approaches to detect or verify closures, they differ in significant ways. For example, the ACD system 119 does not know when or where there is a closure, and therefore, the ACD system 119 can be monitoring a large geographic area looking for a closure. This potentially means monitoring the entire world all the time and can create an enormous resource load on the system 100. Therefore, in one embodiment, the ACD system 119 is generally designed with minimal complexity, to make use of GPS probe data map-matched onto roadways running relatively simple algorithms and detecting an anomaly in probe data. These anomalies are flagged as potential closures and sent to the ACV system 121 for verification.

In one embodiment, very different from the ACD system 119, the ACV system 121 monitors only a very small portion of the world only for a short time. For example, the ACV system 121 monitors those roadways, which are reported either by third party providers or by the ACD system 119, and then monitors them only for a short time (e.g., until the ACV system 121 decides that the road is open). This can happen, for instance, in case of false closure reports, or after a valid closure the road reopens.

In one embodiment, this significantly lower load gives the ACV system 121 the luxury to run more complex algorithms than the ACD system 119. For example, the ACV system 121 increases system complexity in ways such as but not limited to:

(1) Given a reported road segment to monitor, the ACV system 121 builds a connected road graph around this road segment and monitors the traffic on this road graph; and (2) From map-matched probes, the ACV system 121 builds vehicle paths to extract more information and features on driving patterns, potential problems on the road, and/or other features related to verifying a road closure.

Figure 6A:
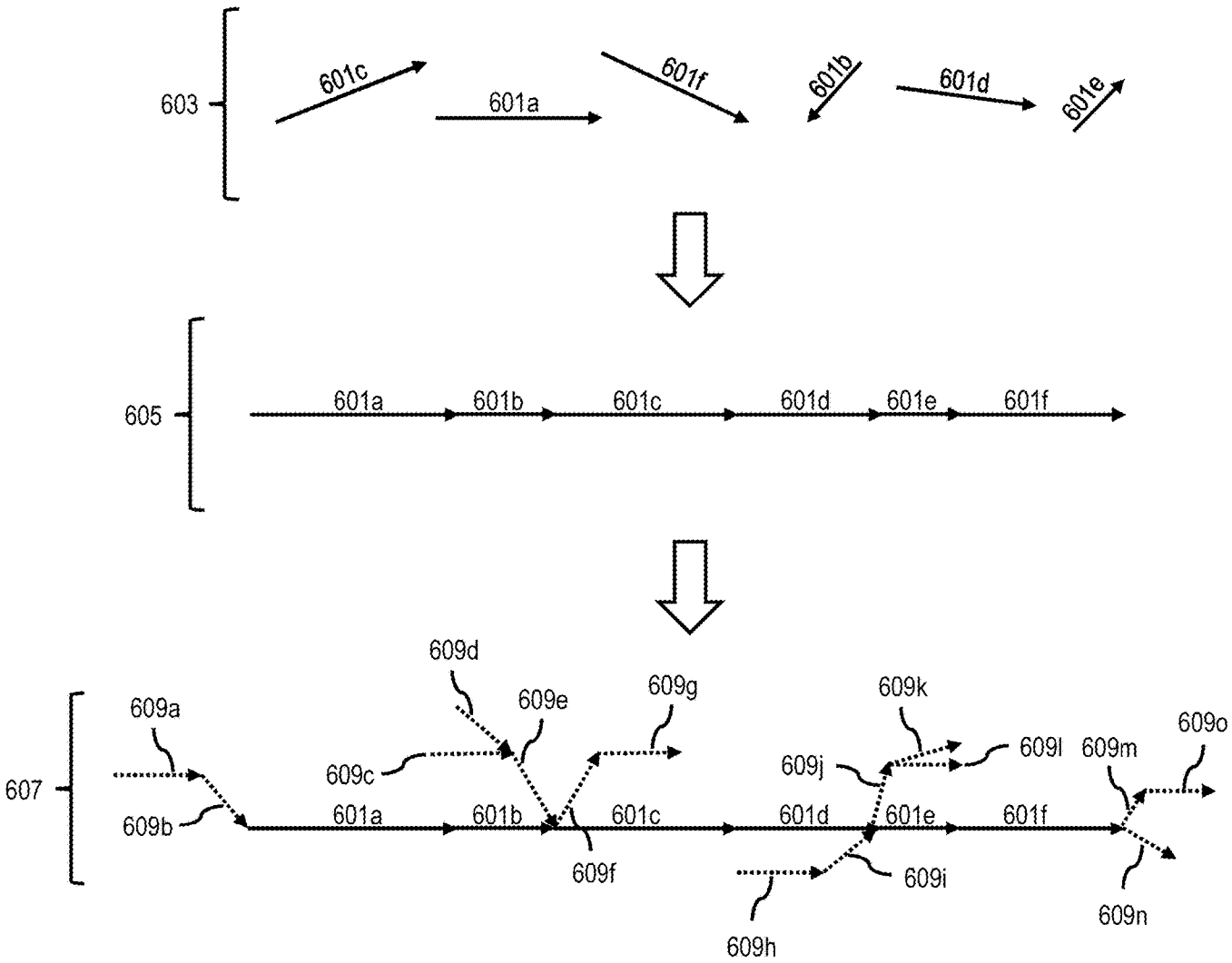
FIGS. 6A and 6B are diagrams illustrating an example of constructing a roadway graph, according to one embodiment.

The following sections describe how connected road graphs and vehicle paths are generated. In one embodiment, the roadway or closure link graph (i.e., used synonymously herein) is used to seal or designate the reported closure area and monitor traffic around and through the closure within the area represented by the closure link graph. As described above, a closure incident is reported on a stretch of roadway (e.g., via a road closure report 101). This closure report 101 is then converted into a set of links. As shown in FIG. 6A, these links (e.g., links 601*a*-601*f*, also collectively referred to as links 601) can be and unordered set 603 (e.g., unordered with respect to a spatial arrangement).

If the links 601 are unordered, the ACV system 121 initiates the building of the closure link graph around these links 601 by ordering the links 601 so that the end of one link is arranged to match the beginning of the next closest link based on the respective locations of their beginning and end nodes. The ordered set 605 of the links 601 is also illustrated in FIG. 6A. The ordered set 605 of the links 601 corresponds to the abstract representation of the physical structure road segments making up the roadway indicated in the road closure report 101.

Next, the ACV system 121 adds links upstream to and downstream from the reported closures to construct the closure link graph 607. Since these links (e.g., links 609*a*-609*o*, also collectively referred to as links 609) are not among the original links 601 identified in the road closure report 101, the links 609 are assumed to be open and not closed to traffic. The resulting the roadway or closure link graph 607 then includes the reportedly closed links 601 buffered by links 609 that are open for travel. In other words, with the addition of open upstream and downstream links 609, the closure (e.g., on links 601) is now isolated. For example, given the closure links 601, all traffic going into and out of the closure region can be monitored using the traffic flowing in the open links 609.

In one embodiment, the flow of traffic is determined by collecting probe data from vehicles. For example, the ACV system 121 retrieves probe data collected from vehicles traveling on the roadways corresponding to the closure link graph 607. In one embodiment, probe data includes raw GPS probes (e.g., probe points) sent from vehicles indicating their respective locations by, for instance, a latitude and longitude pair. Then, each probe point is placed onto a most probable link on the map using a map matching process. On example map-matching process works as described in the following section. A map is defined by a set of links and their geographic coordinates. Because GPS (or other similar location positioning technology) is not 100% accurate, the coordinates of a vehicle GPS probe most of the time do not fall onto a link perfectly. To account for this error, map matching algorithms take the coordinate of a GPS probe, and find the neighboring links whose coordinates are close to the probe. Then, the map matching process places the vehicle probe onto the most probable link based on pre-defined criteria of the specific map matching process or algorithm being used.

In one embodiment, to better control for map matching error, the ACV system 121 described herein works with vehicle paths instead of map matched vehicle probes. The reason is that map matched vehicle probes can be more are susceptible to map matching errors than vehicle paths. By way of example, a vehicle path or trajectory is derived from two consecutive map matched vehicle probes. The path can then be increased by adding new probe points on top of the previously calculated vehicle path as new probe points are collected.

In one embodiment, the ACV system 121 can process the probe data to calculate vehicle paths traversing the monitored closure link graph 407 according to the example process described below. Firstly, for a specific vehicle, the ACV system 121 takes the first and second probe points received, e.g., denoted as probe1 and probe2. If the time difference between these probes is more than a specified threshold, the ACV system 121 discards the initial probe1, and the sets probe1=probe2. The ACV system 121 then retrieves the next probe point to set as probe 2 to iteratively evaluate the time difference.

If the time difference is less than the specified threshold, the ACV system 121 builds a vehicle path from probe1 to probe2. It is contemplated that the ACV system 121 can use any path building process or algorithm such as but not limited to A* pathfinding or equivalent. The ACV system 121 then records the new path for the vehicle, discards probe1, sets probe1=probe2, and retrieves the next probe point to act as probe2 until all probe points collected for the specific vehicle have been processed.

In one embodiment, every vehicle can send its probe points (e.g., GPS probes) at a different frequency; this frequency can vary from 1 second to a few minutes. Therefore, as a vehicle drives through multiple links, there is no guarantee that it will send a probe from every link. For instance, if a vehicle drives at fast speeds over short links while sending a probe every 2 minutes, it would almost be certain that its two consecutive probes will arrive from non-neighboring links. This sporadic or sparse probe reporting can make it more technically challenging to build accurate vehicle paths.

To address this technical challenge, in one embodiment, as part of its link graph building process, the ACV system 121 can aggregate links and their probes where it makes sense into superlinks. In one embodiment, a superlink consists of ordered links such that if a vehicle travels through one of its links, it is guaranteed to travel through the other links of the same superlink as well. An example of a superlink is a section of a highway stretching between two entrance/exit ramps. When on this stretch a vehicle must go through all the links part when driving this stretch. Another example is a roadway between two intersections in a city road. Because a superlink comprises one or more links, superlinks are often longer than normal links of the geographic database 109, thereby increasing the probability that a probe point of a vehicle path would fall on the superlink than on a normal link. In addition, the superlinks can decrease the overall complexity of the closure link graph 607 without affecting the quality of the closure evaluation results, thereby reducing computing resources (e.g., processing resources, memory resources, bandwidth resources, etc.) associated with automatic evaluation of road closure reports according to the various embodiments described herein.

Figure 6B:
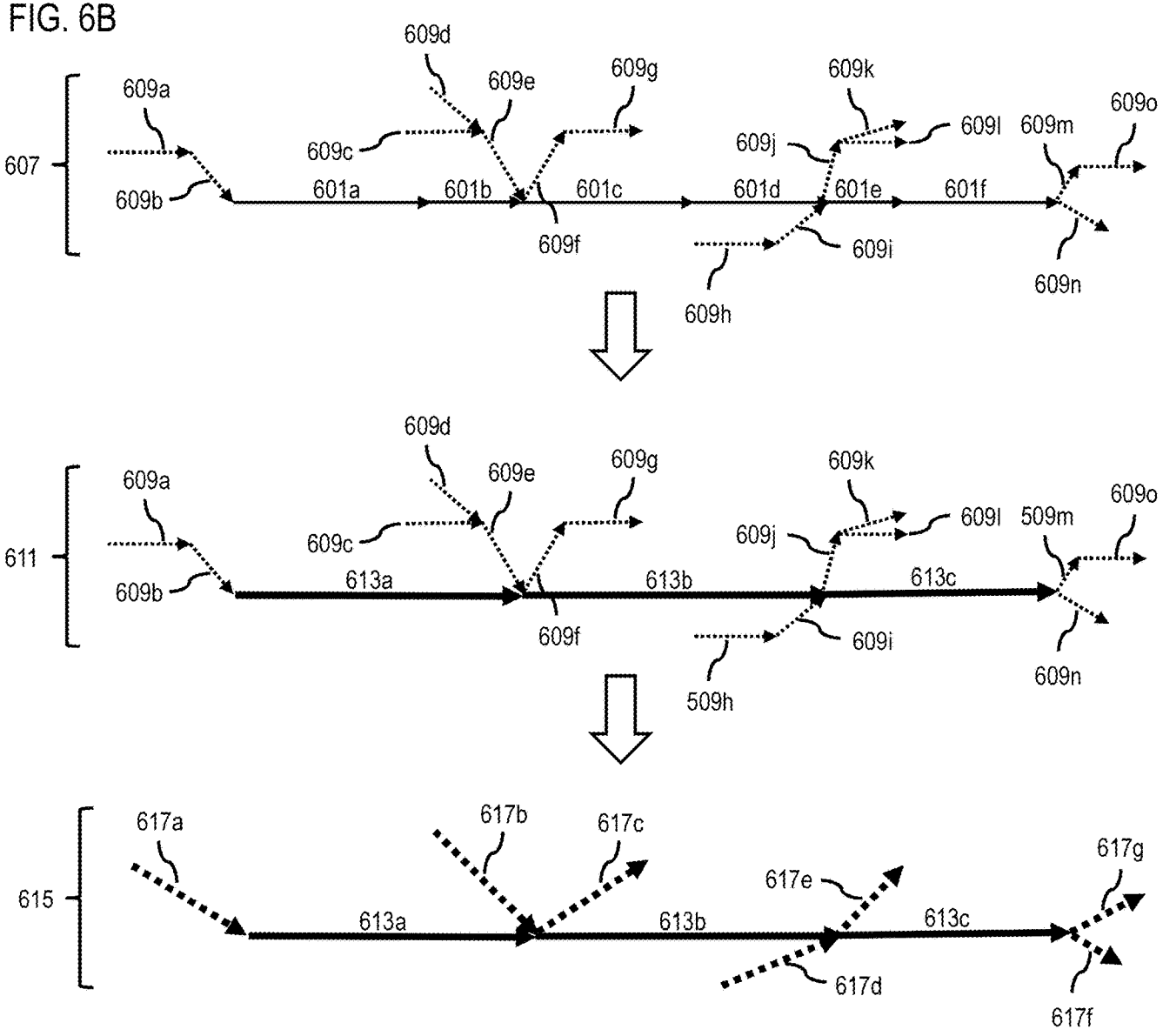

FIG. 6B is diagram of an example of aggregating road links of the closure link graph 607 into superlinks, according to one embodiment. FIG. 6B continues the example closure link graph 607 of FIG. 6A and illustrates a first superlink graph 611 that is a version of the closure link graph 607 in which the reportedly closed links 601 are aggregated into respective superlinks. In this example, links 601*a* and 601*b* can form a superlink 613*a* because a vehicle on link 601*a* must also travel through link 601*b*. Similarly, links 601*c* and 601*d* can be aggregated as superlink 613*b*, and links 601*e* and 601*f* can be aggregated into superlink 613*c*.

In one embodiment, the upstream and downstream links 609 can be aggregated into superlinks in addition to the links 601 to construct superlink graph 615. For example, links 609*a* and 609*b* can be aggregated into superlink 617*a*, links 609*c*-609*e* can be aggregated into superlink 617*b*, links 609*f* and 609*g* can be aggregated into superlink 617*c*, links 609*h* and 609*i* can be aggregated into superlink 617*d*, links 609*j*-6091 can be aggregated into superlink 617*e*, and links 609*m* and 609*o* can be aggregated into superlink 617*g*. Referring for instance to the example of FIGS. 6A and 6B, if a vehicle has probe points on link 601*a*, 601*c*, and 601*f*, the ACV system 121 can calculate the vehicle path to include links all links 601*a*-601*f* based on the superlinks 613*a*-613*c*. In one embodiment, links and superlinks can be used interchangeably in the various embodiments described herein. Therefore, where links are described without reference superlinks, it is contemplated that superlinks can be used in addition to or as alternate to links, and vice versa.

In one embodiment, while the ACD system 119 only monitors one superlink and has access to probes map-matched on that superlink, with its superlink graph and vehicle paths, the ACV system 121 is armed to compute complex features that the ACD system 119 generally cannot do. Examples of these features include but are not limited to:

Vehicles passing through a superlink;

Vehicles avoiding/detouring a superlink;

Vehicles which left the main road using the previous exit;

An increased number of vehicles (compared to historical expectations) joining the main road after a specific superlink; and Etc.

While these features evaluated by the ACV system 119 can be powerful, they will have difficulty in identifying closures on roads with low probe volume/vehicle traffic, as illustrated previously. Similar to the ACD system 119, the ACV superlinks can use dynamic windows to highlight anomalies in probe volumes and driving patterns and address potential low volume issues. In one embodiment, these verification dynamic windows are built, activated, and updated the same way as in the ACD system 119 case.

Specifically, when the ACV system 121 starts monitoring a reported closure, it builds a superlink graph around the closure. In one embodiment, the superlinks in the graph have a dynamic window with different lengths. In order to construct features and start evaluating reported superlinks (e.g., flagged as detected road closures by the ACD system 119), the ACV system 121 has to wait for all superlinks to fill up and activate their windows. For instance, if a superlink has a dynamic window of 16 hours length, then the ACV system 121 waits for 16 hours before starting closure evaluations for this reported closure. In this example, this is a very long delay; in those 16 hours the closure might be cleared or even if it is active, the traffic system of the mapping platform 111 may not be monitoring it and evaluating it at all.

In one embodiment, instead of waiting for the entire duration for all superlink dynamic windows to fill up, the embodiments of the ACV system 121 described herein provides several technical solutions to avoid or otherwise shorten that wait time. In one embodiment, as part of its road closure detection process, the ACD system 119 already has dynamic window data for many if not all superlinks, as it is monitoring a large geographic area (e.g., the entire world all the time). In one embodiment, after building its superlink graph around a detected road closure, the ACV system 121 can make use of the data available from the ACD system 119.

To do this, a few differences between the dynamic windows of the ACD system 119 and the ACV system 121 can be highlighted. For example, in the ACD system 119, a superlink's dynamic window is filled with features that depend on that superlink only. In other words, the ACD system 119 uses the probes to calculate the features for a given epoch and then it does not need the probes anymore. On the other hand, in the ACV system 121, the window's features depend on probe data from other superlinks (e.g., links in the road graph around the road closure). This is because these ACV features can be path based and constructed using probes of the same vehicle on multiple superlinks. An example is a detouring feature of a superlink s (e.g., number of vehicles detouring around the superlink s), which is computed from probes that are on different superlinks than superlink s. These features, which come from probes on different parts of the graph, create dependencies between dynamic windows and probes of various superlinks.

This means, if the ACV system 121 is going to reuse the ACD system 119's dynamic window data to compute features for ACV dynamic windows, the ACV system 121 does not need the features from ACD dynamic windows but the actual probes used to calculate the ACD features. This way, the ACV system 121 can construct vehicle paths from these probes coming from different superlinks in previous epochs, and then compute ACV dynamic window features (e.g., verification dynamic window features) for the past epochs. This way, the ACV system 121 constructs the dynamic window content for the past epochs.

In one embodiment, the efficiency of ACV or verification dynamic window construction from ACD or detection dynamic windows depends on window lengths. Specifically, consider the following example, where the ACV system 121 constructs the ACV or verification dynamic window for superlink SL2 using the probes from superlink SL1's ACD or detection window. In other words, the ACV system 121 uses the probes stored in SL1 And SL2's ACD windows. Assume that SL1 has a wider window (e.g., 200 epochs) than SL2 (e.g., 100 epochs). This means, SL1's dynamic window has a history of probes stored longer than what is needed by SL2.

Figure 7A:
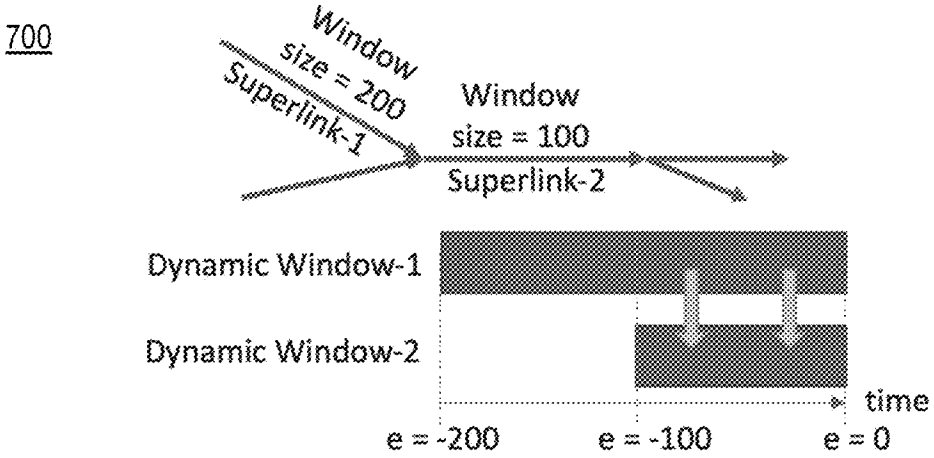
FIGS. 7A and 7B are diagrams illustrating examples of dynamic window data transfer, according to one embodiment.

This is illustrated in FIG. 7A. In the example 700 of FIG. 7A, the current time is, epoch 0. This is when the ACV system 121 starts constructing the dynamic window for SL2. SL2 needs probe data from past 100 epochs (e.g., from epoch −100 until epoch 0 as denoted by dynamic window-2). SL1's ACD window (denoted by dynamic window-1) spans from epoch −200 until epoch 0. Therefore, in this example, both SL1 and SL2 have enough probe data stored in their ACD windows to construct the ACV or verification dynamic window for SL2.

Figure 7B:
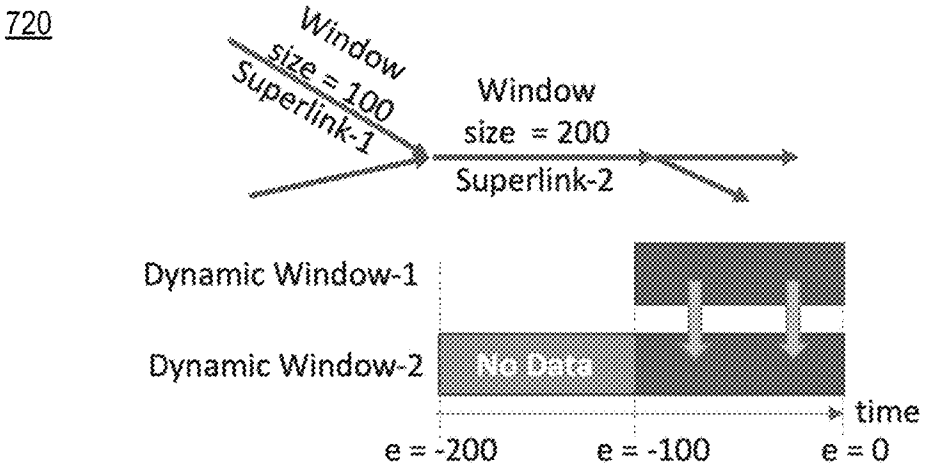

In the example 720 of FIG. 7B, the ACD or detection dynamic window widths are reversed: e.g., SL1 has a narrower window than SL2. The current time is again epoch 0, and the ACV system 121 is trying to construct a dynamic window for SL2. In this case, the dynamic window 1 does not have enough history of probe data and can only serve probes for the second half of SL2's dynamic window.

Returning to the process 200 of FIG. 2 and process 300 of FIG. 3, the various embodiments of these two processes 200 and 300 describe the various technical approaches and solutions to efficiently construct ACV or verification dynamic windows from the ACD or detection dynamic window data under different circumstances.

In 201 of FIG. 2, the ACV system 121 generates a road graph G comprising a plurality of road links associated with a road closure detected by a road closure detection system (e.g., the ACD system 119). As described above, the ACD system 119 stores probe data for the plurality of road links over respective detection dynamic time windows (e.g., with various window sizes) used for detecting the road closure. Then given the road graph G, the ACV system 121 extracts dynamic window sizes (referred as window size, abbreviated as ws from here onwards) for the superlinks in the road graph G. In other words, the ACV system 121 extracts respective verification dynamic time windows for the plurality of road links, and then uses the respective verification dynamic time windows to verify detected road closures (step 203).

In one embodiment, the various embodiments described herein can then be used to quickly activate the generated ACV dynamic windows (e.g., fill them with feature data using the probes stored in ACD dynamic windows). For example, in step 205, the ACV system 121 can fill the respective verification dynamic time windows using the probe data stored by the ACD system 119 using one or more of the embodiments of the technical solutions described in the process 300 of FIG. 3 below. In step 207, the ACV system 121 can initiate a verification of the detected road closure based on the filled respective verification dynamic time windows (e.g., by calculating the ACV features and then verifying the road closure based on those features as described previously).

In one embodiment, as a base solution (also referred to as Solution 0 or S0), the ACV system 121 does not use any information from the ACD dynamic windows. Then, for each superlink i in the road graph G, the ACV system 121 waits for the duration of their verification time window sizes to fill. For example, if a window size for a superlink i is equal to 100 epochs (e.g., ws(i)=100), the delay time for superlink i to become active is 100 (e.g., the delay time until the window is filled to trigger calculating ACV features) as follows:

$$\text{delay}(S0)=\text{ws}(i)=100 \text{ epochs}$$

In one embodiment, the process 300 provides embodiments of alternative solutions to filling the ACV time windows that are then compared to Solution 0 in terms of how much they reduce the delay in activating of filling ACV dynamic windows of the road graph G (e.g., comprising superlinks around the road closure detected by the ACD system 119).

In step 301 of the process 300, for a given superlink i, the ACV system 121 determines if its window size ws(i) is a minimum of all the window sizes in the road graph G (step 303). If the ws(i) is a minimum, then the ACV system 121 uses the probe data in the dynamic windows of all superlinks in G to compile the full dynamic window for superlink i. In other words, all the ACD dynamic windows in the graph cover longer time intervals from the past than required by superlink i's ACV dynamic window. Hence with no delay, ACV dynamic window of i can be constructed (step 305). In summary, the ACV system 121 selects a given road link from the plurality of road links for the verification of the road closure. The verification can then be initiated after the filling of the respective verification dynamic time windows without delay based on determining that a respective verification dynamic time window for the road link is a minimum the plurality of road links.

However, if ws(i) is not the minimum over all the window sizes in the road graph G, then at least some of the ACD dynamic windows of G will not be covering enough history that is required to construct the ACV dynamic window for i. Steps 307, 309, and 311 provide different solutions that can be applied for this scenario, and they all aim to reduce the activation delay for superlink i's ACV dynamic window.

In step 307, the ACV system 121 can apply Solution 1 (also referred to as S1). In one embodiment, Solution 1 looks for the smallest ACD dynamic window in the graph, takes this minimum window length L and constructs features for L epochs of superlink i's ACV dynamic window. As per the problem definition previously described, superlink i's ACV dynamic window is wider than L. Because of this, the ACD window with the minimum window length L in the road graph G cannot fill up the ACV window for superlink i. Instead, the ACV system 121 can start the superlink i's ACV window with these L-epoch features, monitor the probes on the graph and keep building the dynamic window until it gets activated.

In summary, in one embodiment of Solution 1, the ACV system 121 selects a road link from the plurality of road links for the verification of the road closure and determines that a respective verification dynamic time window for the road link is not a minimum among the plurality of road links. The ACV system 121 then determines the minimum verification dynamic time window from the respective verification dynamic time windows in the road graph, and uses the probe data from a most recent time period covered by the minimum verification dynamic time window to partially fill the respective verification dynamic time windows. The verification of the detected road closure can then be initiated based on performing additional monitoring of the road graph to fill a remaining portion of the respective verification dynamic time windows.

Consider the following example in which ws(i)=100 epochs and the minimum window size (also referred to as ws_min) among the superlinks of the road graph G, ws_min (G), =5 epochs. Then, the ACV system 121 uses the probes observed in the most recent 5 epochs across the road graph G (e.g., from ACD windows of all superlinks on the graph) and constructs the first 5 features for superlink i. Then, the ACV system 121 adds these features as the first 5 entries for superlink i's ACV dynamic window. The ACV system 121 then starts monitoring probes and generates features until ws(i) is full and active. If ws(i) remains constant at 100, then ACV waits for 95 epochs to fill the window and activate window(i).

In one embodiment, the gain of Solution 1 in time over the base Solution 0 is the number of epochs of the superlink with the minimum window size, and is expressed in the following format: gain(S1; S0) relative to the delay before activation for solution 1, delay(S1), and solution 0, delay(S0), can then be expressed as:

$$\text{delay}(S1) = ws(i) - \text{ws_min}(G) = 100 - 5 = 95 \text{ epochs}$$

$$\begin{aligned}\text{gain}(S1; S0) &= \text{delay}(S0) - \text{delay}(S1)\\ &= ws(i) - [ws(i) - \text{ws_min}(G)]\\ &= \text{ws_min}(G)\\ &= 5 \text{ epochs}\end{aligned}$$

In step 309, the ACV system 121 can apply Solution 2 (also referred to as S2). In one embodiment, under Solution 2, the ACV system 121 defines a local neighborhood N(i) around superlink i, which comprises other superlinks in that road graph G, that are needed to calculate features for i. In one embodiment, Solution 2 can be further bifurcated into two variants Solution 2a (also referred to as S2a) and Solution 2b (also referred to as S2b).

According to one embodiment of Solution 2a, if ws(i) is the minimum window size among all other superlinks' window sizes in N(i), then the probe data in the neighborhood is used to calculate features and fill the entire dynamic window for superlink i. In summary, in one embodiment of Solution 2a, the ACV system 121 selects a given road link from the plurality of road links for the verification of the road closure. The ACV system 121 defines a local neighborhood graph around the road link, wherein the local neighborhood graph is a subset of the road graph. The verification of the detected road closure can then be initiated based on the filling of the respective verification dynamic time windows for the local neighborhood graph without delay based on determining that a respective verification dynamic time window for the road link is a minimum among the plurality of road links in the local neighborhood graph.

In this case, the delay and gain over Solutions 0 and 1 are as follows:

$$\text{delay}(S2a) = 0$$

$$\begin{aligned}\text{gain}(S2a; S1) &= \text{delay}(S0) - 0\\ &= ws(i)\\ &= 100 \text{ epochs}\end{aligned}$$

-continued $$\begin{aligned}\text{gain}(S2a; S1) &= \text{delay}(S1) - \text{delay}(S2)\\ &= ws(i) - \text{ws_min}(G) - 0\\ &= 95 - 0\\ &= 95 \text{ epochs.}\end{aligned}$$

According to one embodiment of Solution 2b, if ws(i) is not the minimum window size in N(i), then an approach similar to Solution 1 is followed. Continuing with the same example of Solution 1, consider ws(i)=100 and ws_min(G)=5, which belong to superlink j. However, j is not part of N(i). The minimum window size within N(i) is ws_min(N(i))=40. Now, the ACV system 121 uses the probes observed in the most recent 40 epochs across the graph to construct the first 40 features for i. The ACV system 121 then adds them as the first 40 entries for superlink i's ACV dynamic window. Finally, the ACV system 121 monitors probes and generates features until ws(i) is full and active. If ws(i) remains constant at 100, then the ACV system 121 waits for 60 epochs to fill the window and activate window(i).

In summary, in one embodiment of Solution 2b, the ACV system 121 selects a given road link from the plurality of road links for the verification of the road closure. The ACV system 121 defines a local neighborhood graph around the road link. The local neighborhood graph is, for instance, a subset of the road graph. The ACV system 121 determines that a respective verification dynamic time window for the road link is not a minimum among the plurality of road links in the local neighborhood graph, and then determines a minimum verification dynamic time window from the respective verification dynamic time windows in the local neighborhood graph. The ACV system 121 then uses the probe data from a most recent time period covered by the minimum verification dynamic time window to partially fill the respective verification dynamic time windows for the local neighborhood graph. The verification of the detected road closure is then initiated after performing additional monitoring of the local neighborhood graph to fill a remaining portion of the respective verification dynamic time windows.

The delay and gain analysis for Solution 2b is given below:

$$\begin{aligned}\text{delay}(S2b) &= ws(i) - \text{ws_min}(N(i))\\ &= 100 - 40\\ &= 60 \text{ epochs}\end{aligned}$$

$$\begin{aligned}\text{gain}(S2b; S0) &= \text{delay}(S0) - \text{delay}(S2b)\\ &= ws(i) - [ws(i) - \text{ws_min}(N(i))]\\ &= \text{ws_min}(N(i))\\ &= 40 \text{ epochs.}\end{aligned}$$

$$\begin{aligned}\text{gain}(S2b; S1) &= \text{delay}(S1) - \text{delay}(S2b)\\ &= ws(i) - \text{ws_min}(G) - [ws(i) - \text{ws_min}(N(i))]\\ &= \text{ws_min}(N(i)) - \text{ws_min}(G)\\ &= 40 - 5\\ &= 35 \text{ epochs.}\end{aligned}$$

In step 309, the ACV system 121 can apply Solution 3 (also referred to as S3) by starting with a smaller window for a given superlink i and gradually grows the window until it reaches its full size. In one embodiment, the dynamic window reaches its full size, once the expected total volume over all the epochs within the window is just above a threshold, EXPECTED_THRESH. This is the value which drives the size of the window. In other words, in the examples above, when ws(i)=100, it means over the 100 epochs, the total expected volume is just above EXPECTED_THRESH.

One embodiment of Solution 3 relaxes this condition, i.e., the window can have a total expected volume less than EXPECTED_THRESH. As a result, a smaller window size can be used to activate the window and start ACV feature calculation. The following example clarifies this approach:

$$ws(i)=100,\ \text{ws_min}(G)=5,\ \text{ws_min}(N(i))=40 \text{ and } \text{EXPECTED_THRESH}=10.$$

Solution 3 relaxes EXPECTED_THRESH to EXPECTED_THRESH' such that the window is activated once the total expected volume in the window is just above EXPECTED_THRESH' instead of EXPECTED_THRESH based on the following: EXPECTED_THRESH'=EXPECTED_THRESH/2=5.

Let's also assume that this relaxed condition produces a preliminary window w' by reducing the window size from 100 (ws(i)) to 55 (ws'(i)). This allows w' to activate earlier, such that the superlink i can be evaluated sooner.

In one embodiment, the ACV system 121 can then follow the same approach as either in Solution 1 or Solution 2 to fill up the window for i. Once the window size reaches ws'(i)=55 (e.g., based on total expected volume of the window ws'(i) being 5), the temporary window becomes active. The temporary window differs from the ordinary dynamic window, such that its size will keep growing while its total expected volume increases from the relaxed EXPECTED_THRESH' value of 5 until it gets just above EXPECTED_THRESH value of 10. Once the total expected volume of the window reaches EXPECTED_THRESH, the preliminary window becomes the dynamic window, and it grows and shrinks following its original rules.

In summary, in one embodiment of Solution 3, the ACV system 121 selects a road link from the plurality of road links for the verification of the road closure. Based on determining that a respective verification dynamic time window for the road link is not a minimum among the plurality of road links, the ACV system 121 calculates a reduced threshold for determining the respective verification dynamic time windows. By way of example, the reduced threshold is less than an original threshold for determining the respective verification dynamic time windows. The verification of the detected road closure can then be initiated based on filling the respective verification dynamic time windows based on the reduced threshold. In one embodiment, the ACV system 121 can perform additional monitoring of the road graph until the original threshold for determining the respective verification dynamic time windows is met, and then update the verification based on the additional monitoring. Alternatively, the verification can be initiated after the filling of the respective verification dynamic time windows without delay based on determining that a respective verification dynamic time window for the road link is a minimum among the plurality of road links. In yet another embodiment, the ACV system 121 determines a minimum verification dynamic time window from the respective verification dynamic time windows and uses the probe data from a most recent time period covered by the minimum verification dynamic time window to partially fill the respective verification dynamic time windows. The verification can then be initiated based on performing additional monitoring of the road graph to fill a remaining portion of the respective verification dynamic time windows.

With the embodiments of Solution 3, the gain in time over Solution 0 depends on which of Solutions 1 or 2b that Solution 3 is combined with (Solution 2a is skipped). This results in the following variants of Solution 3: (1) Solution 3a: Solution 3+Solution 0; (2) Solution 3b: Solution 3+Solution 1; and (3) Solution 3c: Solution 3+Solution 1. The delay and gain analyses for these variants are provided below. Recall that delay(S0) is 100 epochs:

$$\text{Solution } 3a: \text{Solution } 3 + \text{Solution } 0$$

$$\text{delay}(S3a) = ws'(i) = 55 \text{ epochs}$$

$$\begin{aligned}\text{gain}(S3a; S0) &= \text{delay}(S0) - \text{delay}(S3a)\\ &= ws(i) - ws'(i)\\ &= 100 - 55\\ &= 45 \text{ epochs.}\end{aligned}$$

$$\text{Solution } 3b: \text{Solution } 3 + \text{Solution } 1$$

$$\begin{aligned}\text{delay}(S3b) &= ws'(i) - \text{ws_min}(G)\\ &= 55 - 5\\ &= 50 \text{ epochs.}\end{aligned}$$

$$\begin{aligned}\text{gain}(S3b; S0) &= \text{delay}(S0) - \text{delay}(S1,\ S3b)\\ &= ws(i) - ws'(i) - \text{ws_min}(G)\\ &= 100 - 50\\ &= 50 \text{ epochs.}\end{aligned}$$

$$\begin{aligned}\text{gain}(S3b; S1) &= \text{delay}(S1) - \text{delay}(S3b)\\ &= ws(i) - \text{ws_min}(G) - [ws'(i) - \text{ws_min}(G)]\\ &= ws(i) - ws'(i)\\ &= 100 - 55\\ &= 45 \text{ epochs.}\end{aligned}$$

$$\text{Solution } 3c: \text{Solution } 3 + \text{Solution } 2b$$

$$\begin{aligned}\text{delay}(S3c) &= ws'(i) - \text{ws_min}(N(i))\\ &= 55 - 40\\ &= 15 \text{ epochs.}\end{aligned}$$

$$\begin{aligned}\text{gain}(S3c; S0) &= \text{delay}(S0) - \text{delay}(S3c)\\ &= ws(i) - [ws'(i) - \text{ws_min}(N(i))]\\ &= 100 - 15\\ &= 85 \text{ eopchs.}\end{aligned}$$

$$\begin{aligned}\text{gain}(S3c; S1) &= \text{delay}(S1) - \text{delay}(S3c)\\ &= ws(i) - \text{ws_min}(G) - [ws'(i) - \text{ws_min}(N(i))]\\ &= 95 - 15\\ &= 80 \text{ epochs.}\end{aligned}$$

$$\begin{aligned}\text{gain}(S3c; S2b) &= \text{delay}(S2b) - \text{delay}(S3c)\\ &= ws(i) - \text{ws_min}(N(i)) - [ws'(i) - \text{ws_min}(N(i))]\\ &= ws(i) - ws'(i)\\ &= 100 - 55\\ &= 45 \text{ epochs.}\end{aligned}$$

In one embodiment, the ACV system 121 can perform another variant of Solution 3 (e.g., Solution 3d). For example, solution 3d would look to again follow the framework for Solution 3 but apply a methodology/intelligence to weighting/scaling what the new EXPECTED_THRESH' should be. In one embodiment, Solution 3 alone would look to set a threshold that is still acceptable in terms of accuracy to provide quicker decisions out of the ACV process. However, solution 3d would start with the assumption that using the Neighborhood superlinks N(i), taking the windows as an aggregate can be used to scale what a new temporary window should be for the superlink i, ws(i)=100. In this case, an aggregated historical volume over the Neighborhood (in terms of density) should still equate or otherwise approximate to the original EXPECTED_THRESH=10. This aggregated number could be calculated by processes including but not limited to a mean, median, distance weighted mean, etc. In one embodiment, to mitigate the risk of extreme cases that would diminish the potential for the ACV system 121 to identify significant context differences, a minimum expected vehicle threshold can also be set.

With this aggregated number, the ACV system 121 could then use the rest of the Solution 3 framework to fill up the window for i. Once the window size reaches ws'(i)=AG (e.g., the Aggregated Number based on total expected volume of the window across the Neighborhood), the temporary window becomes active.

One example would be three individual superlinks within the strand graph that are either within the Evaluable zone or Original zone:

| | |
|---|---|
| SL1 window = 5 | SL1 length = 1000 m |
| SL2 window = 100 | SL2 length = 100 m |
| SL3 window = 15 | SL3 length = 1000 m |

In this example, the new simple mean window size for SL2 would be ws'(2)=40. The new distance weighted mean window size for SL2 would be ws'(2)=15 (e.g., rounded up from 14.29).

In summary, in one embodiment of Solution 3d, the ACV system 121 defines a local neighborhood graph around the road link. The local neighborhood graph is, for instance, a subset of the road graph. The ACV system 121 then aggregates historical data from the local neighborhood graph to determine the reduced threshold. The ACV system 121 then performs Solution 3 using the determined reduced threshold.

The delay or gain would be similar to the previously stated Solution 3c gain: Solution 3+Solution 2b. For instance, following the example above, the gain would be 60 epochs (100–40) based on a simple mean, or the gain would be 85 epochs (100–15) based on a distance weighted mean.

Returning to FIG. 1, in one embodiment, the mapping platform 111 (e.g., including the ACD system 119 and ACV system 121) has connectivity over the communication network 115 to other components of the system 100 including but not limited to road closure reports 101, services platform 103, services 105, content providers 107, geographic database 109, and/or probe database 117. Byway of example, the services 105 may also be other third-party services and include traffic incident services (e.g., to report road closures), mapping services, navigation services, travel planning services, notification services, social networking services, content (e.g., audio, video, images, etc.) provisioning services, application services, storage services, contextual information determination services, location-based services, information-based services (e.g., weather, news, etc.), etc. In one embodiment, the services platform 103 uses the output (e.g., road closure detections and verifications) of the mapping platform 111 to provide services such as navigation, mapping, other location-based services, etc.

In one embodiment, the mapping platform 111 may be a platform with multiple interconnected components. The mapping platform 111 may include multiple servers, intelligent networking devices, computing devices, components and corresponding software for providing parametric representations of lane lines. In addition, it is noted that the mapping platform 111 may be a separate entity of the system 100, a part of the one or more services 105, a part of the services platform 103, or included within the vehicle 113.

In one embodiment, content providers 107*a*-107*m* (collectively referred to as content providers 107) may provide content or data (e.g., including geographic data, road closure reports, etc.) to the geographic database 109, the mapping platform 111, the services platform 103, the services 105, and the vehicle 113. The content provided may be any type of content, such as traffic incident content (e.g., road closure reports), map content, textual content, audio content, video content, image content, etc. In one embodiment, the content providers 107 may provide content that may aid in the detecting and classifying of road closures or other traffic incidents. In one embodiment, the content providers 107 may also store content associated with the geographic database 109, mapping platform 111, services platform 103, services 105, and/or vehicle 113. In another embodiment, the content providers 107 may manage access to a central repository of data, and offer a consistent, standard interface to data, such as a repository of the geographic database 109.

In one embodiment, the vehicles 113, for instance, are part of a probe-based system for collecting probe data for detecting traffic incidents and/or measuring traffic conditions in a road network. In one embodiment, each vehicle 113 is configured to report probe data as probe points, which are individual data records collected at a point in time that records telemetry data for that point in time. In one embodiment, the probe ID can be permanent or valid for a certain period of time. In one embodiment, the probe ID is cycled, particularly for consumer-sourced data, to protect the privacy of the source.

In one embodiment, a probe point can include attributes such as: (1) probe ID, (2) longitude, (3) latitude, (4) heading, (5) speed, and (6) time. The list of attributes is provided by way of illustration and not limitation. Accordingly, it is contemplated that any combination of these attributes or other attributes may be recorded as a probe point. For example, attributes such as altitude (e.g., for flight capable vehicles or for tracking non-flight vehicles in the altitude domain), tilt, steering angle, wiper activation, etc. can be included and reported for a probe point. In one embodiment, the vehicles 113 may include sensors for reporting measuring and/or reporting attributes. The attributes can also be any attribute normally collected by an on-board diagnostic (OBD) system of the vehicle, and available through an interface to the OBD system (e.g., OBD II interface or other similar interface). In one embodiment, this data allows the system 100 to calculate or construct vehicle paths of a vehicle 113 over a stretch of road (e.g., over a closure link graph).

The probe points can be reported from the vehicles 113 in real-time, in batches, continuously, or at any other frequency requested by the system 100 over, for instance, the communication network 115 for processing by the mapping platform 111. The probe points also can be mapped to specific road links stored in the geographic database 109. In one embodiment, the system 100 can generate probe traces (e.g., vehicle paths or trajectories) from the probe points for an individual probe so that the probe traces represent a travel trajectory or vehicle path of the probe through the road network.

In one embodiment, the vehicle 113 is configured with various sensors for generating or collecting vehicular sensor data, related geographic/map data, etc. In one embodiment, the sensed data represent sensor data associated with a geographic location or coordinates at which the sensor data was collected. In this way, the sensor data can act as observation data that can be separated into location-aware training and evaluation datasets according to their data collection locations as well as used for evaluating road closure reports according to the embodiments described herein. By way of example, the sensors may include a radar system, a LiDAR system, a global positioning sensor for gathering location data (e.g., GPS), a network detection sensor for detecting wireless signals or receivers for different short-range communications (e.g., Bluetooth, Wi-Fi, Li-Fi, near field communication (NFC) etc.), temporal information sensors, a camera/imaging sensor for gathering image data, an audio recorder for gathering audio data, velocity sensors mounted on steering wheels of the vehicles, switch sensors for determining whether one or more vehicle switches are engaged, and the like.

Other examples of sensors of the vehicle 113 may include light sensors, orientation sensors augmented with height sensors and acceleration sensor (e.g., an accelerometer can measure acceleration and can be used to determine orientation of the vehicle), tilt sensors to detect the degree of incline or decline of the vehicle along a path of travel, moisture sensors, pressure sensors, etc. In a further example embodiment, sensors about the perimeter of the vehicle 113 may detect the relative distance of the vehicle from a physical divider, a lane or roadway, the presence of other vehicles, pedestrians, traffic lights, potholes and any other objects, or a combination thereof. In one scenario, the sensors may detect weather data, traffic information, or a combination thereof. In one embodiment, the vehicle 113 may include GPS or other satellite-based receivers to obtain geographic coordinates from satellites for determining current location and time. Further, the location can be determined by visual odometry, triangulation systems such as A-GPS, Cell of Origin, or other location extrapolation technologies. In yet another embodiment, the sensors can determine the status of various control elements of the car, such as activation of wipers, use of a brake pedal, use of an acceleration pedal, angle of the steering wheel, activation of hazard lights, activation of head lights, etc.

In one embodiment, the communication network 115 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

By way of example, the mapping platform 111, services platform 103, services 105, vehicle 113, and/or content providers 107 communicate with each other and other components of the system 100 using well known, new or still developing protocols. In this context, a protocol includes a set of rules defining how the network nodes within the communication network 115 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 8:
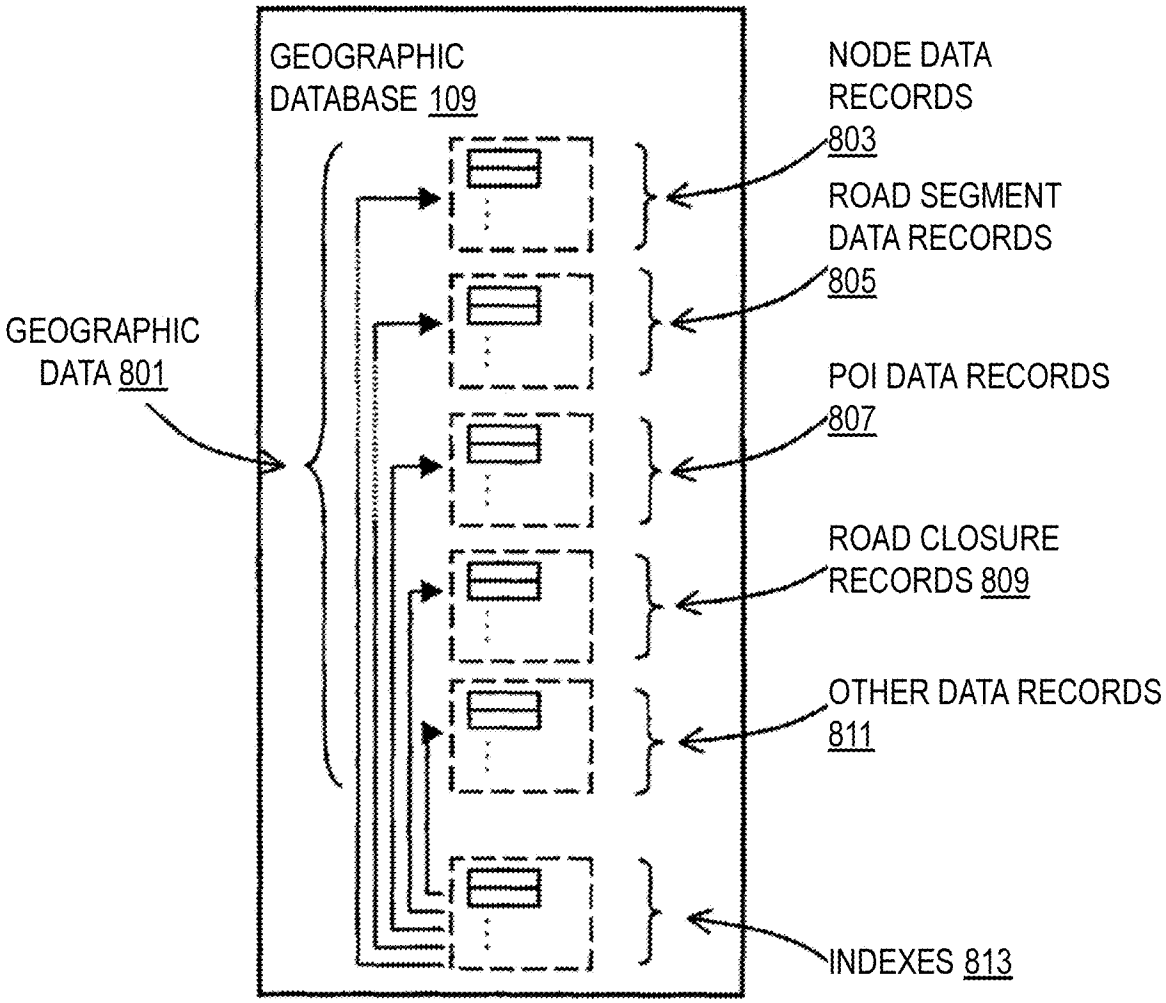
FIG. 8 is a diagram of a geographic database, according to one embodiment.

FIG. 8 is a diagram of a geographic database, according to one embodiment. In one embodiment, the geographic database 109 includes geographic data 801 used for (or configured to be compiled to be used for) mapping and/or navigation-related services. In one embodiment, geographic features (e.g., two-dimensional or three-dimensional features) are represented using polygons (e.g., two-dimensional features) or polygon extrusions (e.g., three-dimensional features). For example, the edges of the polygons correspond to the boundaries or edges of the respective geographic feature. In the case of a building, a two-dimensional polygon can be used to represent a footprint of the building, and a three-dimensional polygon extrusion can be used to represent the three-dimensional surfaces of the building. It is contemplated that although various embodiments are discussed with respect to two-dimensional polygons, it is contemplated that the embodiments are also applicable to three-dimensional polygon extrusions. Accordingly, the terms polygons and polygon extrusions as used herein can be used interchangeably.

In one embodiment, the following terminology applies to the representation of geographic features in the geographic database 109.

"Node"—A point that terminates a link.

"Line segment"—A straight line connecting two points.

"Link" (or "edge")—A contiguous, non-branching string of one or more line segments terminating in a node at each end.

"Shape point"—A point along a link between two nodes (e.g., used to alter a shape of the link without defining new nodes).

"Oriented link"—A link that has a starting node (referred to as the "reference node") and an ending node (referred to as the "non reference node").

"Simple polygon"—An interior area of an outer boundary formed by a string of oriented links that begins and ends in one node. In one embodiment, a simple polygon does not cross itself.

"Polygon"—An area bounded by an outer boundary and none or at least one interior boundary (e.g., a hole or island). In one embodiment, a polygon is constructed from one outer simple polygon and none or at least one inner simple polygon. A polygon is simple if it just consists of one simple polygon, or complex if it has at least one inner simple polygon.

In one embodiment, the geographic database 109 follows certain conventions. For example, links do not cross themselves and do not cross each other except at a node. Also, there are no duplicated shape points, nodes, or links. Two links that connect each other have a common node. In the geographic database 109, overlapping geographic features are represented by overlapping polygons. When polygons overlap, the boundary of one polygon crosses the boundary of the other polygon. In the geographic database 109, the location at which the boundary of one polygon intersects they boundary of another polygon is represented by a node. In one embodiment, a node may be used to represent other locations along the boundary of a polygon than a location at which the boundary of the polygon intersects the boundary of another polygon. In one embodiment, a shape point is not used to represent a point at which the boundary of a polygon intersects the boundary of another polygon.

As shown, the geographic database 109 includes node data records 803, road segment or link data records 805, POI data records 807, road closure data records 809, other records 811, and indexes 813, for example. More, fewer or different data records can be provided. In one embodiment, additional data records (not shown) can include cartographic ("carto") data records, routing data, and maneuver data. In one embodiment, the indexes 813 may improve the speed of data retrieval operations in the geographic database 109. In one embodiment, the indexes 813 may be used to quickly locate data without having to search every row in the geographic database 109 every time it is accessed. For example, in one embodiment, the indexes 813 can be a spatial index of the polygon points associated with stored feature polygons.

In exemplary embodiments, the road segment data records 805 are links or segments representing roads, streets, or paths, as can be used in the calculated route or recorded route information for determination of one or more personalized routes. The node data records 803 are end points corresponding to the respective links or segments of the road segment data records 805. The road link data records 805 and the node data records 803 represent a road network, such as used by vehicles, cars, and/or other entities. Alternatively, the geographic database 109 can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 109 can include data about the POIs and their respective locations in the POI data records 807. The geographic database 109 can also include data about places, such as cities, towns, or other communities, and other geographic features, such as bodies of water, mountain ranges, etc. Such place or feature data can be part of the POI data records 807 or can be associated with POIs or POI data records 807 (such as a data point used for displaying or representing a position of a city).

In one embodiment, the geographic database 109 includes the road closure data records 809 for storing inconsistency-resolved road closure data, predicted road closure reports, road closure evaluations, road closure link graphs, associated probe data/vehicle paths, extracted features derived from the probe data, and/or any other related data. The road closure data records 809 comprise of the road closure data layer 119 that store the automatically generated road closure classifications generated according to the various embodiments described herein. The road closure data layer 123 can be provided to other system components or end users to provided related mapping, navigation, and/or other location-based services. In one embodiment, the road closure data records 809 can be associated with segments of a road link (as opposed to an entire link). It is noted that the segmentation of the road for the purposes of physical divider prediction can be different than the road link structure of the geographic database 109. In other words, the segments can further subdivide the links of the geographic database 109 into smaller segments (e.g., of uniform lengths such as 5-meters). In this way, road closures or other traffic incidents can be predicted and represented at a level of granularity that is independent of the granularity or at which the actual road or road network is represented in the geographic database 109. In one embodiment, the road closure data records 809 can be associated with one or more of the node records 803, road segment or link records 805, and/or POI data records 807; or portions thereof (e.g., smaller or different segments than indicated in the road segment records 805) to provide situational awareness to drivers and provide for safer autonomous operation of vehicles.

In one embodiment, the geographic database 109 can be maintained by the content provider 107 in association with the services platform 103 (e.g., a map developer). The map developer can collect geographic data to generate and enhance the geographic database 109. There can be different ways used by the map developer to collect data. These ways can include obtaining data from other sources, such as municipalities or respective geographic authorities. In addition, the map developer can employ field personnel to travel by vehicle along roads throughout the geographic region to observe features (e.g., road closures or other traffic incidents, etc.) and/or record information about them, for example. Also, remote sensing, such as aerial or satellite photography, can be used.

In one embodiment, the geographic database 109 include high resolution or high definition (HD) mapping data that provide centimeter-level or better accuracy of map features. For example, the geographic database 109 can be based on Light Detection and Ranging (LiDAR) or equivalent technology to collect billions of 3D points and model road surfaces and other map features down to the number lanes and their widths. In one embodiment, the HD mapping data capture and store details such as the slope and curvature of the road, lane markings, roadside objects such as sign posts, including what the signage denotes. By way of example, the HD mapping data enable highly automated vehicles to precisely localize themselves on the road, and to determine road attributes (e.g., learned speed limit values) to at high accuracy levels.

In one embodiment, the geographic database 109 is stored as a hierarchical or multilevel tile-based projection or structure. More specifically, in one embodiment, the geographic database 109 may be defined according to a normalized Mercator projection. Other projections may be used. By way of example, the map tile grid of a Mercator or similar projection is a multilevel grid. Each cell or tile in a level of the map tile grid is divisible into the same number of tiles of that same level of grid. In other words, the initial level of the map tile grid (e.g., a level at the lowest zoom level) is divisible into four cells or rectangles. Each of those cells are in turn divisible into four cells, and so on until the highest zoom or resolution level of the projection is reached.

In one embodiment, the map tile grid may be numbered in a systematic fashion to define a tile identifier (tile ID). For example, the top left tile may be numbered 00, the top right tile may be numbered 01, the bottom left tile may be numbered 10, and the bottom right tile may be numbered 11. In one embodiment, each cell is divided into four rectangles and numbered by concatenating the parent tile ID and the new tile position. A variety of numbering schemes also is possible. Any number of levels with increasingly smaller geographic areas may represent the map tile grid. Any level (n) of the map tile grid has 2(n+1) cells. Accordingly, any tile of the level (n) has a geographic area of A/2(n+1) where A is the total geographic area of the world or the total area of the map tile grid 10. Because of the numbering system, the exact position of any tile in any level of the map tile grid or projection may be uniquely determined from the tile ID.

In one embodiment, the system 100 may identify a tile by a quadkey determined based on the tile ID of a tile of the map tile grid. The quadkey, for example, is a one-dimensional array including numerical values. In one embodiment, the quadkey may be calculated or determined by interleaving the bits of the row and column coordinates of a tile in the grid at a specific level. The interleaved bits may be converted to a predetermined base number (e.g., base 10, base 4, hexadecimal). In one example, leading zeroes are inserted or retained regardless of the level of the map tile grid in order to maintain a constant length for the one-dimensional array of the quadkey. In another example, the length of the one-dimensional array of the quadkey may indicate the corresponding level within the map tile grid 10. In one embodiment, the quadkey is an example of the hash or encoding scheme of the respective geographical coordinates of a geographical data point that can be used to identify a tile in which the geographical data point is located.

The geographic database 109 can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by the vehicle 113, for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

The processes described herein for providing dynamic window data transfer between road closure detection and road closure verification may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 9:
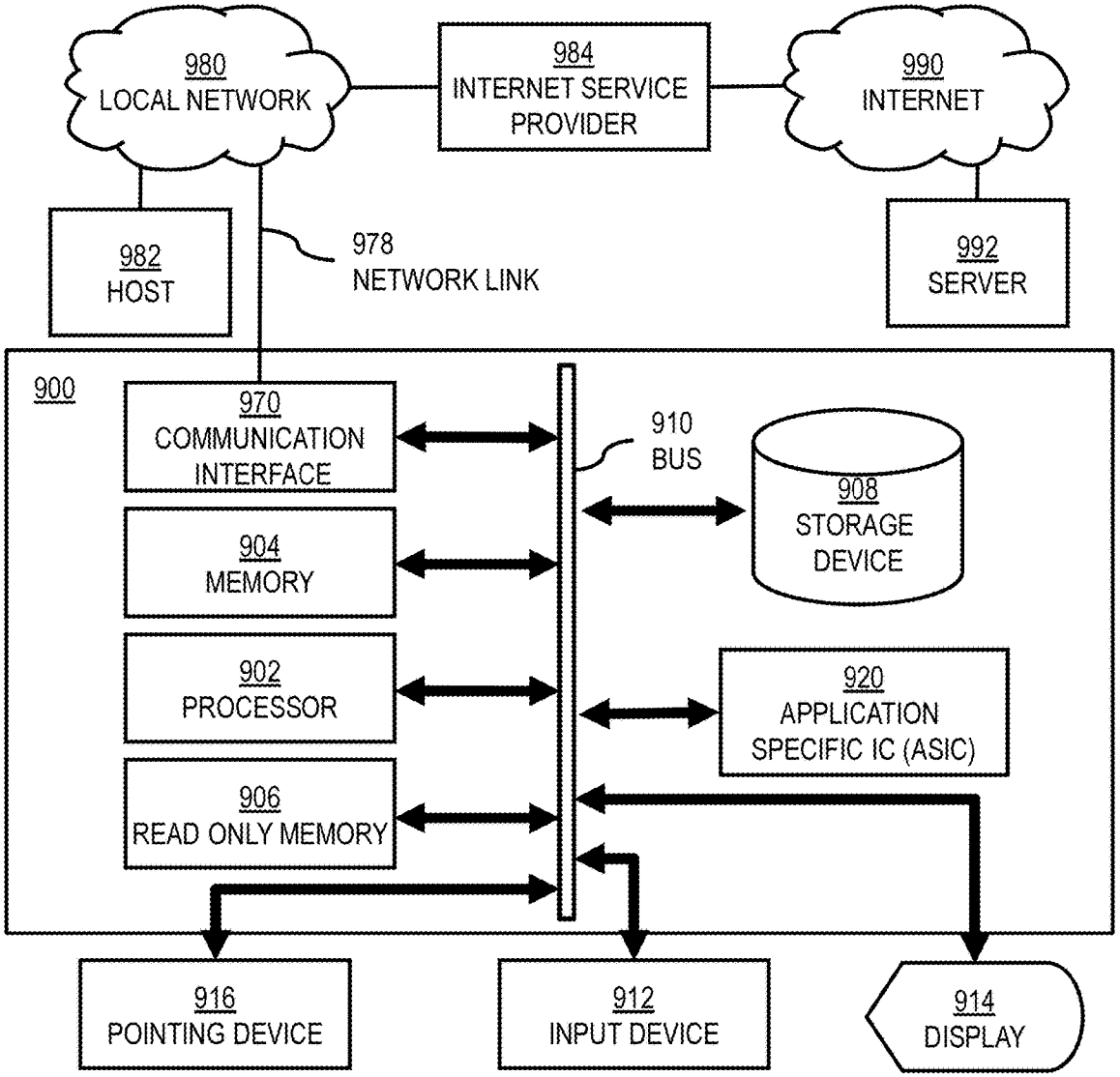
FIG. 9 is a diagram of hardware that can be used to implement an embodiment.

FIG. 9 illustrates a computer system 900 upon which an embodiment of the invention may be implemented. Computer system 900 is programmed (e.g., via computer program code or instructions) to provide dynamic window data transfer between road closure detection and road closure verification as described herein and includes a communication mechanism such as a bus 910 for passing information between other internal and external components of the computer system 900. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 910 includes one or more parallel conductors of information so that information is transferred quickly among devices coupled to the bus 910. One or more processors 902 for processing information are coupled with the bus 910.

A processor 902 performs a set of operations on information as specified by computer program code related to providing dynamic window data transfer between road closure detection and road closure verification. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 910 and placing information on the bus 910. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 902, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 900 also includes a memory 904 coupled to bus 910. The memory 904, such as a random access memory (RAM) or other dynamic storage device, stores information including processor instructions for providing dynamic window data transfer between road closure detection and road closure verification. Dynamic memory allows information stored therein to be changed by the computer system 900. RAM allows a unit of information stored at a location called a memory address to be stored and retrieved independently of information at neighboring addresses. The memory 904 is also used by the processor 902 to store temporary values during execution of processor instructions. The computer system 900 also includes a read only memory (ROM) 906 or other static storage device coupled to the bus 910 for storing static information, including instructions, that is not changed by the computer system 900. Some memory is composed of volatile storage that loses the information stored thereon when power is lost. Also coupled to bus 910 is anon-volatile (persistent) storage device 908, such as a magnetic disk, optical disk or flash card, for storing information, including instructions, that persists even when the computer system 900 is turned off or otherwise loses power.

Information, including instructions for providing dynamic window data transfer between road closure detection and road closure verification, is provided to the bus 910 for use by the processor from an external input device 912, such as a keyboard containing alphanumeric keys operated by a human user, or a sensor. A sensor detects conditions in its vicinity and transforms those detections into physical expression compatible with the measurable phenomenon used to represent information in computer system 900. Other external devices coupled to bus 910, used primarily for interacting with humans, include a display device 914, such as a cathode ray tube (CRT) or a liquid crystal display (LCD), or plasma screen or printer for presenting text or images, and a pointing device 916, such as a mouse or a trackball or cursor direction keys, or motion sensor, for controlling a position of a small cursor image presented on the display 914 and issuing commands associated with graphical elements presented on the display 914. In some embodiments, for example, in embodiments in which the computer system 900 performs all functions automatically without human input, one or more of external input device 912, display device 914 and pointing device 916 is omitted.

In the illustrated embodiment, special purpose hardware, such as an application specific integrated circuit (ASIC) 920, is coupled to bus 910. The special purpose hardware is configured to perform operations not performed by processor 902 quickly enough for special purposes. Examples of application specific ICs include graphics accelerator cards for generating images for display 914, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 900 also includes one or more instances of a communications interface 970 coupled to bus 910. Communication interface 970 provides a one-way or two-way communication coupling to a variety of external devices that operate with their own processors, such as printers, scanners and external disks. In general, the coupling is with a network link 978 that is connected to a local network 980 to which a variety of external devices with their own processors are connected. For example, communication interface 970 may be a parallel port or a serial port or a universal serial bus (USB) port on a personal computer. In some embodiments, communications interface 970 is an integrated services digital network (ISDN) card or a digital subscriber line (DSL) card or a telephone modem that provides an information communication connection to a corresponding type of telephone line. In some embodiments, a communication interface 970 is a cable modem that converts signals on bus 910 into signals for a communication connection over a coaxial cable or into optical signals for a communication connection over a fiber optic cable. As another example, communications interface 970 may be a local area network (LAN) card to provide a data communication connection to a compatible LAN, such as Ethernet. Wireless links may also be implemented. For wireless links, the communications interface 970 sends or receives or both sends and receives electrical, acoustic or electromagnetic signals, including infrared and optical signals, that carry information streams, such as digital data. For example, in wireless handheld devices, such as mobile telephones like cell phones, the communications interface 970 includes a radio band electromagnetic transmitter and receiver called a radio transceiver. In certain embodiments, the communications interface 970 enables connection to the communication network 115 for providing dynamic window data transfer between road closure detection and road closure verification.

The term computer-readable medium is used herein to refer to any medium that participates in providing information to processor 902, including instructions for execution. Such a medium may take many forms, including, but not limited to, non-volatile media, volatile media and transmission media. Non-volatile media include, for example, optical or magnetic disks, such as storage device 908. Volatile media include, for example, dynamic memory 904. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

Network link 978 typically provides information communication using transmission media through one or more networks to other devices that use or process the information. For example, network link 978 may provide a connection through local network 980 to a host computer 982 or to equipment 984 operated by an Internet Service Provider (ISP). ISP equipment 984 in turn provides data communication services through the public, world-wide packet-switching communication network of networks now commonly referred to as the Internet 990.

A computer called a server host 992 connected to the Internet hosts a process that provides a service in response to information received over the Internet. For example, server host 992 hosts a process that provides information representing video data for presentation at display 914. It is contemplated that the components of system can be deployed in various configurations within other computer systems, e.g., host 982 and server 992.

FIG. 10 illustrates a chip set 1000 upon which an embodiment of the invention may be implemented. Chip set 1000 is programmed to provide dynamic window data transfer between road closure detection and road closure verification as described herein and includes, for instance, the processor and memory components described with respect to FIG. 9 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 1000 includes a communication mechanism such as a bus 1001 for passing information among the components of the chip set 1000. A processor 1003 has connectivity to the bus 1001 to execute instructions and process information stored in, for example, a memory 1005. The processor 1003 may include one or more processing cores with each core configured to perform independently. A multi-core processor enables multiprocessing within a single physical package. Examples of a multi-core processor include two, four, eight, or greater numbers of processing cores. Alternatively or in addition, the processor 1003 may include one or more microprocessors configured in tandem via the bus 1001 to enable independent execution of instructions, pipelining, and multithreading. The processor 1003 may also be accompanied with one or more specialized components to perform certain processing functions and tasks such as one or more digital signal processors (DSP) 1007, or one or more application-specific integrated circuits (ASIC) 1009. A DSP 1007 typically is configured to process real-world signals (e.g., sound) in real time independently of the processor 1003. Similarly, an ASIC 1009 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1003 and accompanying components have connectivity to the memory 1005 via the bus 1001. The memory 1005 includes both dynamic memory (e.g., RAM, magnetic disk, writable optical disk, etc.) and static memory (e.g., ROM, CD-ROM, etc.) for storing executable instructions that when executed perform the inventive steps described herein to provide dynamic window data transfer between road closure detection and road closure verification. The memory 1005 also stores the data associated with or generated by the execution of the inventive steps.

Figure 11:
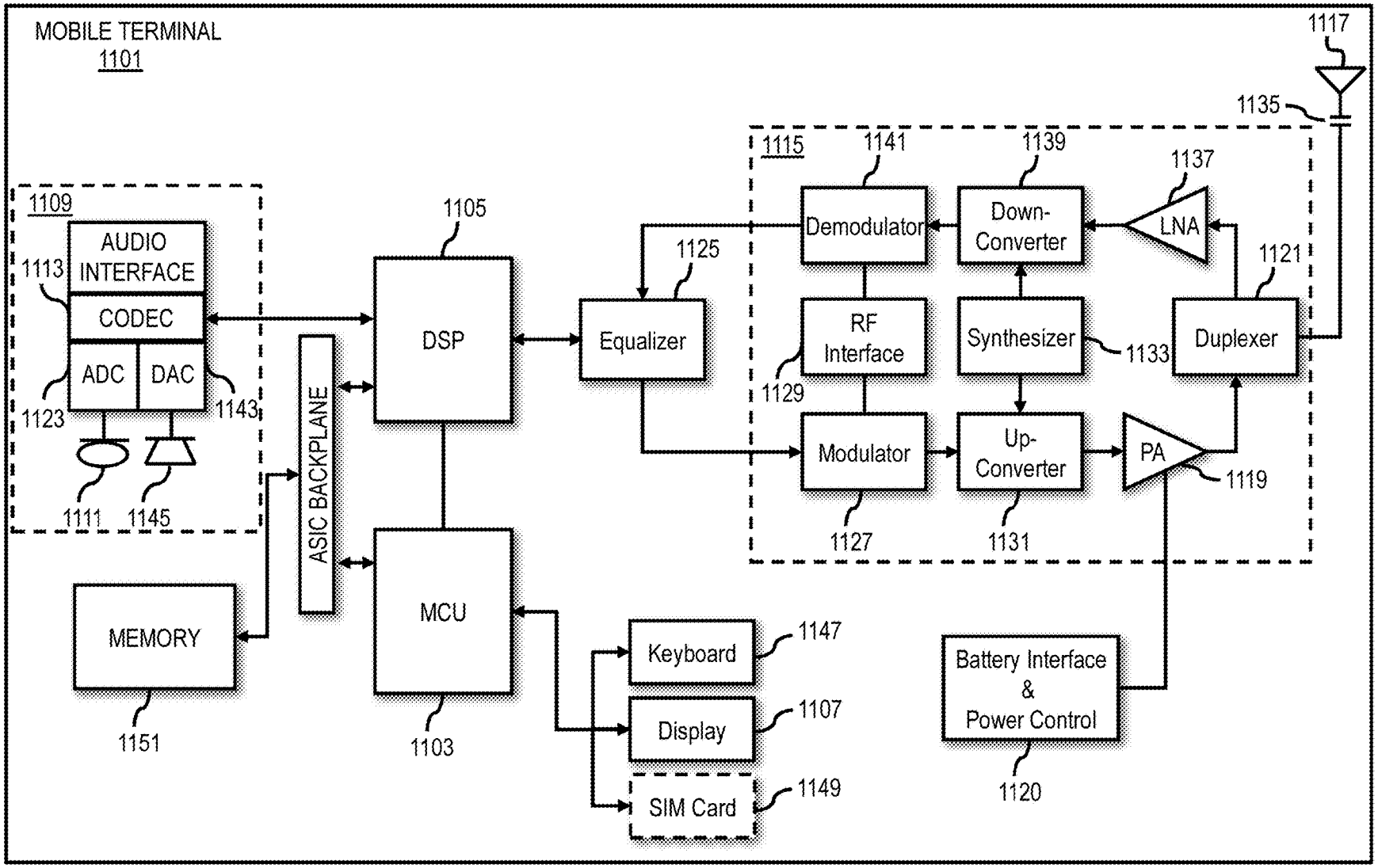
FIG. 11 is a diagram of a mobile terminal (e.g., handset or vehicle or part thereof) that can be used to implement an embodiment.

FIG. 11 is a diagram of exemplary components of a mobile terminal (e.g., handset) capable of operating in the system of FIG. 1, according to one embodiment. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1103, a Digital Signal Processor (DSP) 1105, and a receiver/transmitter unit including a microphone gain control unit and a speaker gain control unit. A main display unit 1107 provides a display to the user in support of various applications and mobile station functions that offer automatic contact matching. An audio function circuitry 1109 includes a microphone 1111 and microphone amplifier that amplifies the speech signal output from the microphone 1111. The amplified speech signal output from the microphone 1111 is fed to a coder/decoder (CODEC) 1113.

A radio section 1115 amplifies power and converts frequency in order to communicate with a base station, which is included in a mobile communication system, via antenna 1117. The power amplifier (PA) 1119 and the transmitter/modulation circuitry are operationally responsive to the MCU 1103, with an output from the PA 1119 coupled to the duplexer 1121 or circulator or antenna switch, as known in the art. The PA 1119 also couples to a battery interface and power control unit 1120.

In use, a user of mobile station 1101 speaks into the microphone 1111 and his or her voice along with any detected background noise is converted into an analog voltage. The analog voltage is then converted into a digital signal through the Analog to Digital Converter (ADC) 1123. The control unit 1103 routes the digital signal into the DSP 1105 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1125 for compensation of any frequency-dependent impairments that occur during transmission though the air such as phase and amplitude distortion. After equalizing the bit stream, the modulator 1127 combines the signal with a RF signal generated in the RF interface 1129. The modulator 1127 generates a sine wave by way of frequency or phase modulation. In order to prepare the signal for transmission, an up-converter 1131 combines the sine wave output from the modulator 1127 with another sine wave generated by a synthesizer 1133 to achieve the desired frequency of transmission. The signal is then sent through a PA 1119 to increase the signal to an appropriate power level. In practical systems, the PA 1119 acts as a variable gain amplifier whose gain is controlled by the DSP 1105 from information received from a network base station. The signal is then filtered within the duplexer 1121 and optionally sent to an antenna coupler 1135 to match impedances to provide maximum power transfer. Finally, the signal is transmitted via antenna 1117 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1101 are received via antenna 1117 and immediately amplified by a low noise amplifier (LNA) 1137. A down-converter 1139 lowers the carrier frequency while the demodulator 1141 strips away the RF leaving only a digital bit stream. The signal then goes through the equalizer 1125 and is processed by the DSP 1105. A Digital to Analog Converter (DAC) 1143 converts the signal and the resulting output is transmitted to the user through the speaker 1145, all under control of a Main Control Unit (MCU) 1103—which can be implemented as a Central Processing Unit (CPU) (not shown).

The MCU 1103 receives various signals including input signals from the keyboard 1147. The keyboard 1147 and/or the MCU 1103 in combination with other user input components (e.g., the microphone 1111) comprise a user interface circuitry for managing user input. The MCU 1103 runs a user interface software to facilitate user control of at least some functions of the mobile station 1101 to provide dynamic window data transfer between road closure detection and road closure verification. The MCU 1103 also delivers a display command and a switch command to the display 1107 and to the speech output switching controller, respectively. Further, the MCU 1103 exchanges information with the DSP 1105 and can access an optionally incorporated SIM card 1149 and a memory 1151. In addition, the MCU 1103 executes various control functions required of the station. The DSP 1105 may, depending upon the implementation, perform any of a variety of conventional digital processing functions on the voice signals. Additionally, DSP 1105 determines the background noise level of the local environment from the signals detected by microphone 1111 and sets the gain of microphone 1111 to a level selected to compensate for the natural tendency of the user of the mobile station 1101.

The CODEC 1113 includes the ADC 1123 and DAC 1143. The memory 1151 stores various data including call incoming tone data and is capable of storing other data including music data received via, e.g., the global Internet. The software module could reside in RAM memory, flash memory, registers, or any other form of writable computer-readable storage medium known in the art including non-transitory computer-readable storage medium. For example, the memory device 1151 may be, but not limited to, a single memory, CD, DVD, ROM, RAM, EEPROM, optical storage, or any other non-volatile or non-transitory storage medium capable of storing digital data.

An optionally incorporated SIM card 1149 carries, for instance, important information, such as the cellular phone number, the carrier supplying service, subscription details, and security information. The SIM card 1149 serves primarily to identify the mobile station 1101 on a radio network. The card 1149 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A computer-implemented method comprising:

generating a road graph comprising a plurality of road links associated with a road closure detected by a road closure detection system, wherein the road closure detection system stores probe data for the plurality of road links over respective detection dynamic time windows used for detecting the road closure;

extracting respective verification dynamic time windows for the plurality of road links, wherein the respective verification dynamic time windows are used by a road closure verification system to verify the road closure;

filling the respective verification dynamic time windows using the probe data stored by the road closure detection system; and initiating a verification of the road closure based on the filled respective verification dynamic time windows.

2. The method of claim 1, further comprising:

selecting a road link from the plurality of road links for the verification of the road closure, wherein the verification is initiated after the filling of the respective verification dynamic time windows without delay based on determining that a respective verification dynamic time window for the road link is a minimum among the plurality of road links.

3. The method of claim 1, further comprising:

selecting a road link from the plurality of road links for the verification of the road closure;

determining that a respective verification dynamic time window for the road link is not a minimum among the plurality of road links;

determining a minimum verification dynamic time window from the respective verification dynamic time windows; and using the probe data from a most recent time period covered by the minimum verification dynamic time window to partially fill the respective verification dynamic time windows, wherein the verification is initiated based on performing additional monitoring of the road graph to fill a remaining portion of the respective verification dynamic time windows.

4. The method of claim 1, further comprising:

selecting a road link from the plurality of road links for the verification of the road closure; and defining a local neighborhood graph around the road link, wherein the local neighborhood graph is a subset of the road graph, wherein the verification is initiated based on the filling of the respective verification dynamic time windows for the local neighborhood graph without delay based on determining that a respective verification dynamic time window for the road link is a minimum among the plurality of road links in the local neighborhood graph.

5. The method of claim 1, further comprising:

selecting a road link from the plurality of road links for the verification of the road closure;

defining a local neighborhood graph around the road link, wherein the local neighborhood graph is a subset of the road graph;

determining that a respective verification dynamic time window for the road link is not a minimum among the plurality of road links in the local neighborhood graph;

determining a minimum verification dynamic time window from the respective verification dynamic time windows in the local neighborhood graph; and using the probe data from a most recent time period covered by the minimum verification dynamic time window to partially fill the respective verification dynamic time windows for the local neighborhood graph, wherein the verification is initiated after performing additional monitoring of the local neighborhood graph to fill a remaining portion of the respective verification dynamic time windows.

6. The method of claim 1, further comprising:

selecting a road link from the plurality of road links for the verification of the road closure;

determining that a respective verification dynamic time window for the road link is not a minimum among the plurality of road links; and calculating a reduced threshold for determining the respective verification dynamic time windows, wherein the reduced threshold is less than an original threshold for determining the respective verification dynamic time windows;

wherein the verification is initiated based on filling the respective verification dynamic time windows based on the reduced threshold.

7. The method of claim 6, further comprising:

performing additional monitoring of the road graph until the original threshold for determining the respective verification dynamic time windows is met; and updating the verification based on the additional monitoring.

8. The method of claim 6, wherein the verification is initiated after the filling of the respective verification dynamic time windows without delay based on determining that a respective verification dynamic time window for the road link is a minimum among the plurality of road links.

9. The method of claim 6, further comprising:

determining a minimum verification dynamic time window from the respective verification dynamic time windows; and using the probe data from a most recent time period covered by the minimum verification dynamic time window to partially fill the respective verification dynamic time windows, wherein the verification is initiated based on performing additional monitoring of the road graph to fill a remaining portion of the respective verification dynamic time windows.

10. The method of claim 6, further comprising:

defining a local neighborhood graph around the road link, wherein the local neighborhood graph is a subset of the road graph;

determining that a respective verification dynamic time window for the road link is not a minimum among the plurality of road links in the local neighborhood graph;

determining a minimum verification dynamic time window from the respective verification dynamic time windows in the local neighborhood graph; and using the probe data from a most recent time period covered by the minimum verification dynamic time window to partially fill the respective verification dynamic time windows for the local neighborhood graph, wherein the verification is initiated after performing additional monitoring of the local neighborhood graph to fill a remaining portion of the respective verification dynamic time windows.

11. The method of claim 6, further comprising:

defining a local neighborhood graph around the road link, wherein the local neighborhood graph is a subset of the road graph; and aggregating historical data from the local neighborhood graph to determine the reduced threshold.

12. An apparatus comprising:

at least one processor; and at least one memory including computer program code for one or more programs, the at least one memory and the computer program code configured to, with the at least one processor, cause the apparatus to perform at least the following, generate a road graph comprising a plurality of road links associated with a road closure detected by a road closure detection system, wherein the road closure detection system stores probe data for the plurality of road links over respective detection dynamic time windows used for detecting the road closure;

extract respective verification dynamic time windows for the plurality of road links, wherein the respective verification dynamic time windows are used by a road closure verification system to verify the road closure;

fill the respective verification dynamic time windows using the probe data stored by the road closure detection system; and initiate a verification of the road closure based on the filled respective verification dynamic time windows.

13. The apparatus of claim 12, wherein the apparatus is further caused to:

select a road link from the plurality of road links for the verification of the road closure, wherein the verification is initiated after the filling of the respective verification dynamic time windows without delay based on determining that a respective verification dynamic time window for the road link is a minimum among the plurality of road links.

14. The apparatus of claim 12, wherein the apparatus is further caused to:

select a road link from the plurality of road links for the verification of the road closure;

determine that a respective verification dynamic time window for the road link is not a minimum among the plurality of road links;

determine a minimum verification dynamic time window from the respective verification dynamic time windows; and use the probe data from a most recent time period covered by the minimum verification dynamic time window to partially fill the respective verification dynamic time windows, wherein the verification is initiated after performing additional monitoring of the road graph to fill a remaining portion of the respective verification dynamic time windows.

15. The apparatus of claim 12, wherein the apparatus is further caused to:

select a road link from the plurality of road links for the verification of the road closure; and define a local neighborhood graph around the road link, wherein the local neighborhood graph is a subset of the road graph, wherein the verification is initiated after the filling of the respective verification dynamic time windows for the local neighborhood graph without delay based on determining that a respective verification dynamic time window for the road link is a minimum among the plurality of road links in the local neighborhood graph.

16. The apparatus of claim 12, wherein the apparatus is further caused to:

select a road link from the plurality of road links for the verification of the road closure;

define a local neighborhood graph around the road link, wherein the local neighborhood graph is a subset of the road graph;

determine that a respective verification dynamic time window for the road link is not a minimum among the plurality of road links in the local neighborhood graph;

determine a minimum verification dynamic time window from the respective verification dynamic time windows in the local neighborhood graph; and use the probe data from a most recent time period covered by the minimum verification dynamic time window to partially fill the respective verification dynamic time windows for the local neighborhood graph, wherein the verification is initiated after performing additional monitoring of the local neighborhood graph to fill a remaining portion of the respective verification dynamic time windows.

17. A non-transitory computer-readable storage medium, carrying one or more sequences of one or more instructions which, when executed by one or more processors, cause an apparatus to perform:

generating a road graph comprising a plurality of road links associated with a road closure detected by a road closure detection system, wherein the road closure detection system stores probe data for the plurality of road links over respective detection dynamic time windows used for detecting the road closure;

extracting respective verification dynamic time windows for the plurality of road links, wherein the respective verification dynamic time windows are used by a road closure verification system to verify the road closure;

filling the respective verification dynamic time windows using the probe data stored by the road closure detection system; and initiating a verification of the road closure based on the filled respective verification dynamic time windows.

18. The non-transitory computer-readable storage medium of claim 17, wherein the apparatus is caused to further perform:

selecting a road link from the plurality of road links for the verification of the road closure, wherein the verification is initiated after the filling of the respective verification dynamic time windows without delay based on determining that a respective verification dynamic time window for the road link is a minimum among the plurality of road links.

19. The non-transitory computer-readable storage medium of claim 17, wherein the apparatus is caused to further perform:

selecting a road link from the plurality of road links for the verification of the road closure;

determining that a respective verification dynamic time window for the road link is not a minimum among the plurality of road links;

determining a minimum verification dynamic time window from the respective verification dynamic time windows; and using the probe data from a most recent time period covered by the minimum verification dynamic time window to partially fill the respective verification dynamic time windows, wherein the verification is initiated after performing additional monitoring of the road graph to fill a remaining portion of the respective verification dynamic time windows.

20. The non-transitory computer-readable storage medium of claim 17, wherein the apparatus is caused to further perform:

selecting a road link from the plurality of road links for the verification of the road closure; and defining a local neighborhood graph around the road link, wherein the local neighborhood graph is a subset of the road graph, wherein the verification is initiated after the filling of the respective verification dynamic time windows for the local neighborhood graph without delay based on determining that a respective verification dynamic time window for the road link is a minimum among the plurality of road links in the local neighborhood graph.

* * * * *